US012352109B2

(12) United States Patent
Mensa-Wilmot

(10) Patent No.: US 12,352,109 B2
(45) Date of Patent: Jul. 8, 2025

(54) REAMERS WITH IMPROVED DURABILITY AND/OR STABILITY

(71) Applicant: Chevron U.S.A. Inc., San Ramon, CA (US)

(72) Inventor: Graham Mensa-Wilmot, Cypress, TX (US)

( * ) Notice: Subject to any disclaimer, the term of this patent is extended or adjusted under 35 U.S.C. 154(b) by 0 days.

(21) Appl. No.: 18/552,889

(22) PCT Filed: Mar. 29, 2021

(86) PCT No.: PCT/US2021/024735
§ 371 (c)(1),
(2) Date: Sep. 27, 2023

(87) PCT Pub. No.: WO2022/211782
PCT Pub. Date: Oct. 6, 2022

(65) Prior Publication Data
US 2024/0368946 A1 Nov. 7, 2024

(51) Int. Cl.
*E21B 10/32* (2006.01)

(52) U.S. Cl.
CPC ..... *E21B 10/32* (2013.01)

(58) Field of Classification Search
CPC ..... E21B 10/32; E21B 10/26
See application file for complete search history.

(56) References Cited

U.S. PATENT DOCUMENTS

2010/0276201 A1* 11/2010 Makkar ..... E21B 10/32 175/57
2010/0326742 A1 12/2010 Vempati
2011/0005841 A1 1/2011 Wood
2014/0048335 A1 2/2014 Mensa-Wilmot
2014/0048336 A1* 2/2014 Mensa-Wilmot ..... E21B 10/43 175/266
2014/0151133 A1 6/2014 Simmons
2015/0068813 A1* 3/2015 Moreno ..... E21B 10/32 175/263

(Continued)

OTHER PUBLICATIONS

PCT International Search Report and Written Opinion, mailed on Jun. 23, 2021, issued in International Application No. PCT/US2021/024735, filed on Mar. 29, 2021, 9 pages.

*Primary Examiner* — Brad Harcourt
(74) *Attorney, Agent, or Firm* — Smith & Woldesenbet Law Group, PLLC

(57) ABSTRACT

A reamer for use in enlarging a borehole in a drilling operation, the reamer comprising: an elongate body defining a rotational axis about which the reamer is rotated in the drilling operation; and a plurality of reamer blocks configured to extend radially outwards from the elongate body relative to the rotational axis, wherein: each reamer block comprises at least a first row of cutters configured to engage a formation in which the borehole is being drilled with a given back rake in the drilling operation, a given portion of each first row extending longitudinally along its reamer block, a longitudinal direction being substantially parallel to the rotational axis; each back rake of said cutters is either a high back rake or a low back rake; and for at least one first row of cutters, the respective back rakes of the cutters alternate along the given portion of the row between one or more high back rakes and one or more low back rakes.

20 Claims, 12 Drawing Sheets

(56) References Cited

U.S. PATENT DOCUMENTS

| | | | | |
|---|---|---|---|---|
| 2020/0056430 | A1 | 2/2020 | Casad | |
| 2020/0149350 | A1 | 5/2020 | Silveus, III | |
| 2020/0392795 | A1* | 12/2020 | Baldwin | E21B 10/26 |

* cited by examiner $\theta_{BR1} < \theta_{BR2}$ $Z_1 > Z_2$

Major ($X_1$) = Minor ($X_1$)

Major ($X_2$) = Minor ($X_2$)

$X_2 > X_1$

Major ($X_4$) > Minor ($X_3$)

Major ($X_6$) > Minor ($X_5$)

$X_3 > X_5$ $X_4 \geq X_6$

REAMERS WITH IMPROVED DURABILITY AND/OR STABILITY

FIELD OF DISCLOSURE

The present disclosure relates in general to reamers, in particular for use in drilling holes or boreholes in a formation through which hydrocarbon materials may be extracted.

BACKGROUND

One type of reamer is an underreamer, used to enlarge a borehole below an existing casing or other restriction during a drilling operation. A drilled diameter may be the same as, or larger than, an internal diameter (ID) of pre-set casing, for example. In the context of a well drilling operation, the hole or borehole may be referred to as a well.

Some reamers are configured to form part of a so-called bottom hole assembly (BHA), being the lowest part of the drill string extending from a drill bit to a drill pipe. In such a BHA, the reamer may follow the drill bit down the hole, and serve to increase the diameter of the hole as initially drilled by the drill bit.

It has been found that present reamers are not sufficiently stable and/or durable, leading to compromises in drilling efficiency, undesirable rates of wear and instability, and consequential failures. Such failures, in addition to compromising drilling performance, also have negative effects on expensive downhole tools, such as logging, imaging, and rotary steerable systems. In addition, the shortcomings in durability can contribute to shorter and/or slower runs, which may in turn force multiple trips and lead to increased operational cost. In hard and/or abrasive formations, as well depths increase, and in depleted environments, the poor durability and/or stability attributes accelerate reamer failures and thus have significant effects on project cost.

It is desirable to address such problems, and in particular to provide reamers with improved durability and/or stability characteristics.

SUMMARY

According to a first aspect of the present disclosure, there is provided a reamer for use in enlarging a borehole in a drilling operation, the reamer comprising: an elongate body defining a rotational axis about which the reamer is rotated in the drilling operation; and a plurality of reamer blocks configured to extend radially outwards from the elongate body relative to the rotational axis, wherein: each reamer block comprises at least a first row of cutters configured to engage a formation in which the borehole is being drilled with a given back rake in the drilling operation, a given portion of each first row extending longitudinally along its reamer block, a longitudinal direction being substantially parallel to the rotational axis; each back rake of said cutters is either a high back rake or a low back rake; and for at least one first row of cutters, the respective back rakes of the cutters alternate along the given portion of the row between one or more high back rakes and one or more low back rakes.

Such a reamer has improved operational durability and/or stability, and addresses torque trends and susceptibility to vibrations, while enhancing hole retention characteristics. The borehole may be a borehole in an earthen formation, such as a rock formation, for example for the extraction of hydrocarbon materials (e.g. oil and/or gas). As such, the borehole may be considered a well, and the drilling operation a well drilling operation.

The reamer blocks may extend outwards from the elongate body in the sense of pointing or facing or protruding outwards from the elongate body. The reamer blocks may be configured to retract into and/or extend out from (in the sense of being moved outwardly from) the elongate body relative to the rotational axis. The reamer may be an underreamer.

A row of cutters may extend longitudinally in the sense of defining a line of cutters which (being straight or curved) extends generally from towards a downhole end towards an uphole end of the reamer block concerned, in a longitudinal direction. The terms high back rake and low back rake may be considered "high" and "low" (large and small) relative to one another.

According to a second aspect of the present disclosure, there is provided a plurality of reamer blocks for mounting to an elongate body of a reamer, the reamer for use in enlarging a borehole in a drilling operation, the elongate body defining a rotational axis about which the reamer is rotated in the drilling operation, the reamer blocks configured to extend radially outwards from the elongate body relative to the rotational axis when mounted to the elongate body, wherein: each reamer block comprises at least a first row of cutters configured to engage a formation in which the borehole is being drilled with a given back rake in the drilling operation, a given portion of each first row extending longitudinally along its reamer block, a longitudinal direction being substantially parallel to the rotational axis when the reamer block is mounted to the elongate body; each back rake of said cutters is either a high back rake or a low back rake; and for at least one first row of cutters, the respective back rakes of the cutters alternate along the given portion of the row between one or more high back rakes and one or more low back rakes.

According to a third aspect of the present disclosure, there is provided a reamer block for mounting to an elongate body of a reamer, the reamer for use in enlarging a borehole in a drilling operation, the elongate body defining a rotational axis about which the reamer is rotated in the drilling operation, the reamer block configured to extend radially outwards from the elongate body relative to the rotational axis when mounted to the elongate body, wherein: the reamer block comprises at least a first row of cutters configured to engage a formation in which the borehole is being drilled with a given back rake in the drilling operation, a given portion of the first row extending longitudinally along its reamer block, a longitudinal direction being substantially parallel to the rotational axis when the reamer block is mounted to the elongate body; each back rake of said cutters is either a high back rake or a low back rake; and for at least said first row of cutters, the respective back rakes of the cutters alternate along the given portion of the row between one or more high back rakes and one or more low back rakes.

According to a fourth aspect of the present disclosure, there is provided a reamer for use in enlarging a borehole in a drilling operation, the reamer comprising a plurality of (first) rows of cutters configured to engage a formation in which the borehole is being drilled with a given back rake in a drilling operation, wherein: each back rake of said cutters is either a high back rake or a low back rake; and for at least one (first) row of cutters, the respective back rakes of the cutters alternate along a given portion of the row between one or more high back rakes and one or more low back rakes.

According to a fifth aspect of the present disclosure, there is provided a reamer for use in enlarging a borehole in a drilling operation, the reamer comprising: an elongate body defining a rotational axis about which the reamer is rotated in the drilling operation; and a plurality of reamer blocks configured to extend radially outwards from the elongate body relative to the rotational axis, wherein: each reamer block comprises at least a first row of cutters configured to engage a formation in which the borehole is being drilled in the drilling operation, a given portion of each first row extending longitudinally along its reamer block, a longitudinal direction being substantially parallel to the rotational axis; each cutter has a first-feature value being a value of a first feature which defines a configuration of the cutter; and for at least one first row of cutters, the respective first-feature values of the cutters alternate along the given portion of the row between one or more high first-feature values and one or more low first-feature values.

According to a sixth aspect of the present disclosure, there is provided a plurality of reamer blocks for mounting to an elongate body of a reamer, the reamer for use in enlarging a borehole in a drilling operation, the elongate body defining a rotational axis about which the reamer is rotated in the drilling operation, the reamer blocks configured to extend radially outwards from the elongate body relative to the rotational axis when mounted to the elongate body, wherein: each reamer block comprises at least a first row of cutters configured to engage a formation in which the borehole is being drilled in the drilling operation, a given portion of each first row extending longitudinally along its reamer block, a longitudinal direction being substantially parallel to the rotational axis when the reamer block is mounted to the elongate body; each cutter has a first-feature value being a value of a first feature which defines a configuration of the cutter; and for at least one first row of cutters, the respective first-feature values of the cutters alternate along the given portion of the row between one or more high first-feature values and one or more low first-feature values.

According to a seventh aspect of the present disclosure, there is provided a reamer block for mounting to an elongate body of a reamer, the reamer for use in enlarging a borehole in a drilling operation, the elongate body defining a rotational axis about which the reamer is rotated in the drilling operation, the reamer block configured to extend radially outwards from the elongate body relative to the rotational axis when mounted to the elongate body, wherein: the reamer block comprises at least a first row of cutters configured to engage a formation in which the borehole is being drilled in the drilling operation, a given portion of the first row extending longitudinally along its reamer block, a longitudinal direction being substantially parallel to the rotational axis when the reamer block is mounted to the elongate body; each cutter has a first-feature value being a value of a first feature which defines a configuration of the cutter; and for at least the first row of cutters, the respective first-feature values of the cutters alternate along the given portion of the row between one or more high first-feature values and one or more low first-feature values.

According to an eighth aspect of the present disclosure, there is provided a reamer for use in enlarging a borehole in a drilling operation, the reamer comprising a plurality of (first) rows of cutters configured to engage a formation in which the borehole is being drilled in a drilling operation, wherein: each cutter has a first-feature value being a value of a first feature which defines a configuration of the cutter; and for at least one (first) row of cutters, the respective first-feature values of the cutters alternate along a given portion of the row between one or more high first-feature values and one or more low first-feature values.

Features of one aspect may be applied to another aspect, and vice versa.

BRIEF DESCRIPTION OF THE DRAWINGS

Reference will now be made, by way of example only, to the accompanying drawings, of which.

DETAILED DESCRIPTION

The description below sets forth example embodiments according to this disclosure. Further example embodiments and implementations will be apparent to those having ordinary skill in the art. Further, those having ordinary skill in the art will recognize that various equivalent techniques may be applied in lieu of, or in conjunction with, the embodiments discussed below, and all such equivalents should be deemed as being encompassed by the present disclosure.

Figure 1:
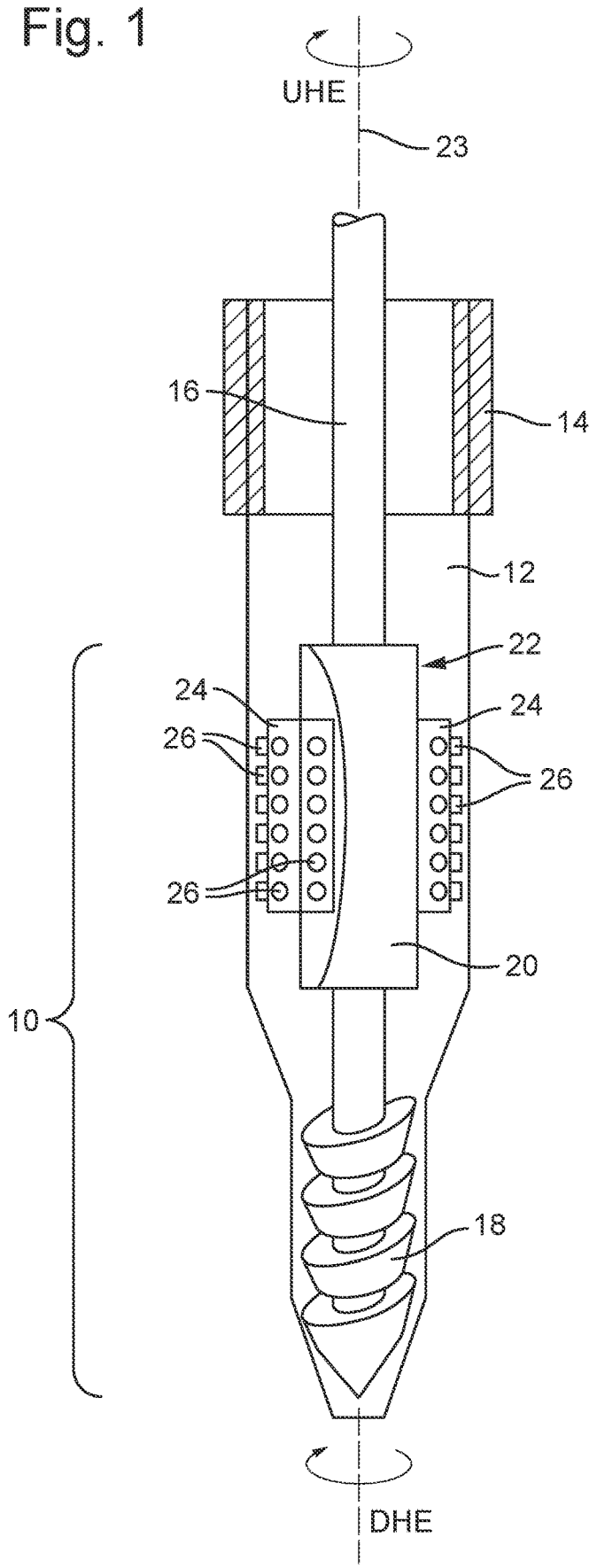
FIG. 1 is a schematic diagram illustrating a bottom hole assembly comprising a reamer and configured to excavate an earthen formation.

FIG. 1 illustrates a BHA 10 configured to excavate an earthen formation, such as a rock formation, to form a hole (borehole or well) including a hole section 12 via which downhole materials/fluids (hydrocarbons and/or other materials) may be extracted. In FIG. 1, the hole section 12 is disposed downhole from a casing 14 having a given internal diameter (ID).

The BHA 10 comprises a drill bit 18, a reamer 20, and/or other components, and is connected to the surface and rotated in the hole section 12 by a drill string 16.

The drill bit 18 is disposed at a distal (or "bottom" or "downhole") end of the drill string 16. Drill bit 18 is configured such that, as the drill string 16 rotates, it is driven to rotate and scrapes, shears, crushes, and/or cuts the earthen formation (e.g. rock) to deepen the hole. Drill bit 18 may be a polycrystalline diamond compact (PDC) bit with one or more PDC cutters. In other instances, drill bit 18 could be a roller-cone bit, a drag bit, a natural diamond or an impregnated bit, for example. The external diameter of drill bit 18 is smaller than the internal diameter of the casing 14, and this facilitates insertion of drill bit 18 into the hole section 12 through the casing 14 after the casing 14 has been set and cemented in place.

The reamer 20 is disposed uphole relative to (or "above") the drill bit 18 in the BHA 10, and is configured to enlarge the hole initially formed by the drill bit 18. Reamer 20 comprises an elongate body 22 and a plurality of reamer blocks 24. The elongate body 22 defines a rotational axis 23 about which the reamer 20 is rotated in the drilling operation. The plurality of reamer blocks 24 are configured to extend radially outwards from the elongate body 22 relative to the rotational axis 23.

The reamer 20, comprising the elongate body 22 and reamer blocks 24, has an external or outer diameter (when the reamer blocks 24 are in a retracted position) that is less than the internal diameter of the casing 14. The reamer blocks 24 are configured to retract into and/or extend from the elongate body 22 relative to the rotational axis 23. With the reamer blocks 24 retracted within the elongate body 22, the reamer 20 can be lowered into the hole section 12 through the hole casing 14. Once the reamer 20 has cleared the casing 14, the reamer blocks 24 may be extended from the elongate body 22. This facilitates the excavation of the hole section 12 by reamer 20 to a larger diameter than the internal diameter of the casing 14. The final hole size drilled by reamer blocks 24 is thus bigger than the hole size drilled by the drill bit 18.

As apparent from FIG. 1, the elongate body 22 may be considered to have a downhole end and an uphole end, the downhole end configured to be downhole of the uphole end in the drilling operation. Similarly, the reamer blocks 24 may be considered to have a downhole end and an uphole end, corresponding (when the reamer blocks 24 are coupled to the elongate body 22 as in FIG. 1) to the downhole and uphole ends of the elongate body 22, respectively (and indeed of the reamer 20 as a whole). The orientation of these downhole and uphole ends relative to one another is indicated by the labels DHE (downhole end) and UHE (uphole end) at the corresponding ends of the rotational axis 23. The labels DHE and UHE are provided elsewhere in the drawings to aid an understanding of the arrangements disclosed herein.

Individual reamer blocks 24 carry cutters 26. The cutters 26 are cutting elements carried on exterior reamer body surfaces of the reamer blocks 24, and are configured to excavate rock and enlarge the hole originally drilled by the drill bit 18. Such excavation may include one or more of scraping, shearing, crushing, cutting, or other excavation mechanisms.

One or more of various design features (or parameters) of the cutters 26 are configured to control the operation of (improve efficiency and overall performance of) the reamer 20 during the excavation process (drilling operation). These features may include one or more of size, diameter, shape, composition, cutter properties (impact vs. abrasion) and/or other features. The size/geometry of a cutter 26 may include one or more of a surface area of cutter 26 extending from a reamer block 24, a volume of cutter 26 extending from a reamer block 24, a height of cutter 26 extending from reamer block 24, a length of a cutting edge of cutter 26, and/or other elements. The orientation or shape of a cutter 26 in a reamer block 24 may refer to a geometric cross-sectional shape, geometric features of the geometric shape, an angle of the face with respect to the side, a back rake of the cutter 26, and/or other variations in shape.

By defining or controlling one or more design features (parameters) of the cutters 26, the efficiency and performance of the reamer 20 in excavating e.g. rock can be improved. Two aspects of the operation of reamer 20, with direct effects on performance that can be controlled through the product design process, are durability and aggressiveness. Aggressiveness, measured as a slope, refers to torque behaviour as a result of changes in weight, as rotary speed is held fixed. As used herein, "weight" relates to the specific tools, drill bit 18 (weight on bit, WOB) and reamer 20 (weight on reamer, WOR), or the force applied by BHA 10 on the drill bit 18 or reamer 20 during the drilling operation. The more aggressive a cutting tool (e.g., drill bit 18 and/or reamer 20) is, the steeper the TQ (torque) vs. WOB slope, leading to a higher likelihood for TQ fluctuations and thus vibrations. Similarly, for a less aggressive tool, the TQ vs. WOB slope is less steep, leading to lower TQ fluctuations and thus less likelihood for vibrations.

The durability of a cutting tool refers to the likelihood of failure during drilling operations, when exposed to specific conditions, environments, and drilling parameters (rotary speed, weight, and flow rate). For a bit and reamer BHA, the following relationships are important or critical:

$$WO_D = WO_B + WO_R$$

$$TQ_D = TQ_B + TQ_R$$

$$RPM_D = RPM_B = RPM_R \text{(when there is no } PDM \text{ in the } BHA\text{)}$$

where subscripts D, B, and R refer to Drilling, Bit 18 and Reamer 20, respectively, where WO refers to Applied Weight, where RPM refers to revolutions per minute, and where PDM refers to Positive-Displacement Motor.

Figure 2:
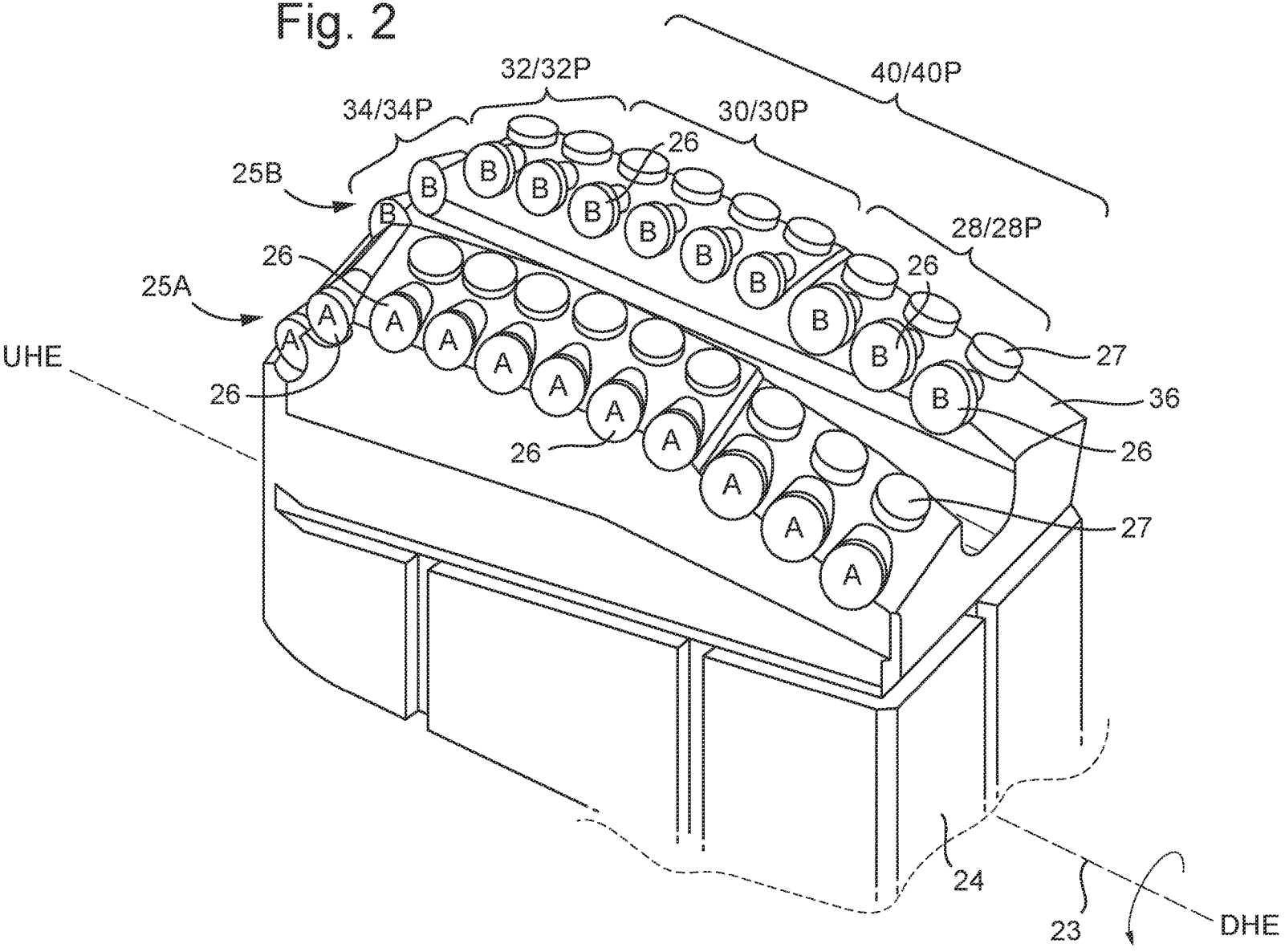
FIGS. 2 and 3 are schematic diagrams illustrating a reamer block for use with the reamer of FIG. 1.
Figure 3:
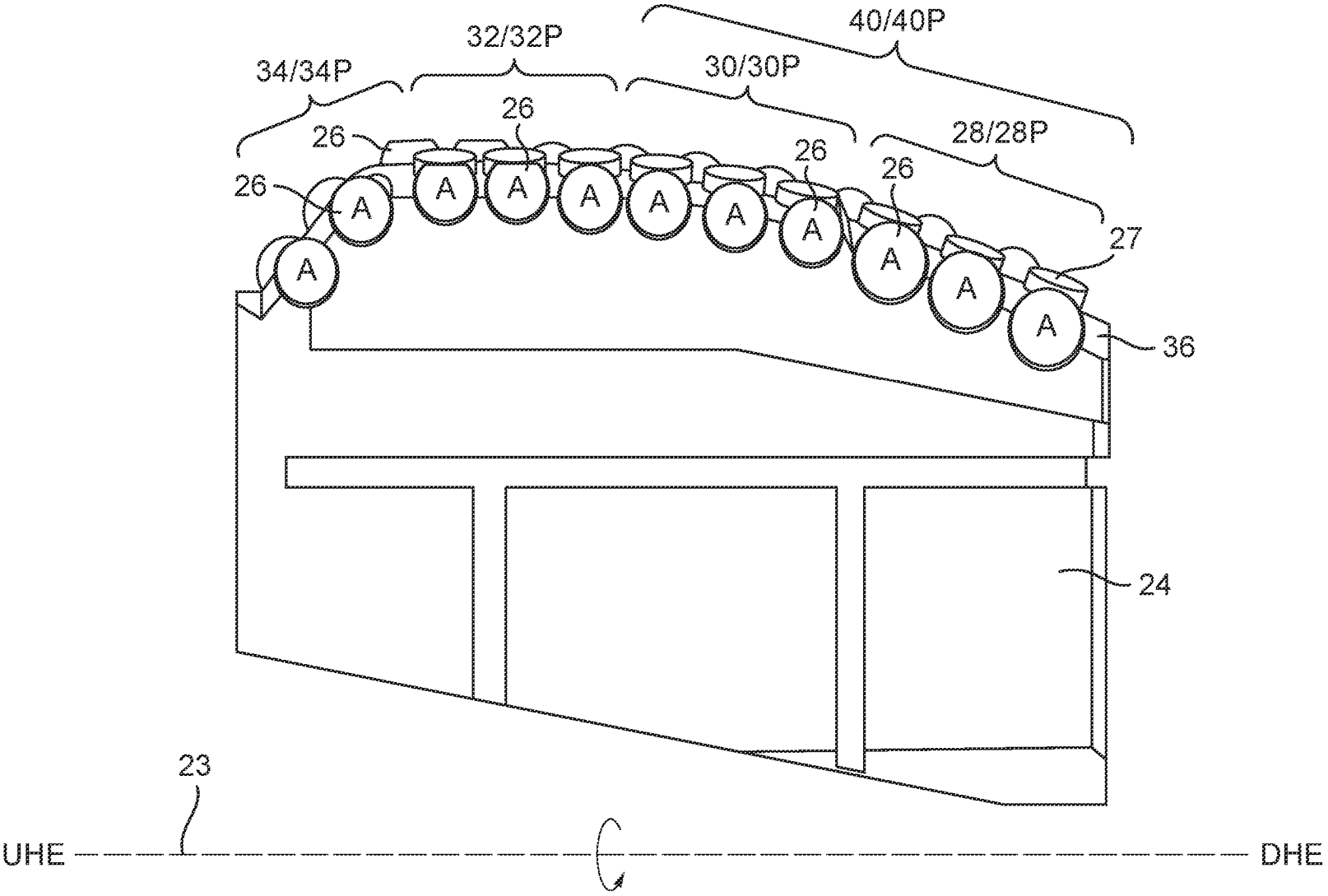

FIGS. 2 and 3 illustrate an example reamer block 24 having disposed thereon a plurality of cutters 26.

As can be seen in FIGS. 2 and 3, the cutters 26 may be arranged in a plurality of rows 25A, 25B (generically, 25) that run longitudinally along the profile of reamer block 24.

Here, a longitudinal direction may be considered substantially parallel to the rotational axis 23 when the reamer block 24 is mounted on the elongate body 22 as in FIG. 1. The general orientation of the rotational axis 23 relative to the reamer block is shown in FIGS. 2 and 3, along with the relative positioning of the downhole and uphole ends, DHE and UHE.

The cutters 26 are configured to engage the formation in the drilling operation. In the present example, two rows 25A and 25B are shown and will be referred to herein as rows A and B, respectively, for convenience. The cutters 26 in FIGS. 2 and 3 have been labelled A or B to identify the row to which they belong. Row A, 25A, may be considered a first row of cutters 26, and row B, 25B, may be considered a second row of cutters 26.

Moreover, considering the direction of rotation to be clockwise when looking in a downhole direction, row A, 25A, may be considered a leading row of cutters and row B, 25B, may be considered a trailing row of cutters 26, given that row B follows row A in the direction of rotation.

Rows of depth of cut limiters 27 are also provided, that prevent cutters 26 on the reamer blocks 24 from over-biting into the formation to create excessive TQ and/or sustain impact damage due to over-loading. In this example, the rows of depth of cut limiters 27 are provided generally parallel to the rows 25 of cutters 26. In this example, each row 25 of cutters 26 is paired with a row of depth of cut limiters 27, with the row of depth of cut limiters 27 trailing its row 25 of cutter 26 in each pair.

Hereinafter, references to rows will be taken as being references to rows 25 of cutters 26 unless stated otherwise.

Although two rows 25, A and B, are shown, a given reamer block 24 may have at least one row, or even only row A or B (i.e. a single row, or only one row). Each reamer block 24 comprises at least a first row of cutters. A given reamer block 24 may have more than two rows, such as rows A, B and C. A given row 25 may or may not form a straight line through the centroids of cutters 26 in the given row (for example, when the row 25 is viewed in a direction towards the rotational axis 23). Nevertheless, a given row 25 may form a smooth (curved or straight) line through the centroids of cutters 26 in the given row.

A given reamer block 24, such as shown in FIGS. 2 and 3, may comprise a plurality of groups of cutters 26. The groups may include one or more opening groups (e.g., a first opening group 28, a second opening group 30, and/or other opening groups), a maintaining group 32, a back-reaming group 34, and/or other groups of cutters 26. An exterior reamer body surface 36 (which may be referred to as a cutter-mounted surface) of the reamer block 24 on which cutters 26 are disposed may have a different profile (e.g. gradient compared to the rotational axis 23) for the different groups of cutters 26.

A hole-opening section of the exterior reamer body surface 36 carrying opening groups 28 and/or 30 may be referred to as a hole-opening section. Those opening groups 28 and/or 30 may be configured to increase a diameter of (or widen) the hole being formed by the reamer 20 as the reamer 20 is moved down into the hole. In this way, a cross-section of the hole perpendicular to the rotational axis 23 may be enlarged. As such, the hole-opening section of the reamer body surface 36 slopes radially inwards along its length towards the downhole end. That is, the hole-opening section of the reamer body surface 36 may be graded such that at a downhole end of the hole-opening section, the exterior reamer body surface 36 is closer to the rotational axis (longitudinal axis) 23 of the elongate body 22 carrying reamer block 24 than the uphole end.

The reamer profile, defined by the exterior reamer body surface 36 of its reamer blocks 24, starts from the outer diameter (OD) of the drill bit 18 with a geometry that is adapted and expected to contribute to stability and durability improvements, as the reamer drills ahead to open/enlarge the borehole.

Where the first and second opening groups 28 and 30 are both provided, the hole-opening section of the exterior reamer body surface 36 may have a similar grading for both groups, or the grading may be steeper for the first opening group 28 than for the second opening group 30 (as apparent from FIG. 3), the first opening group 28 being downhole of the second opening group 30. That is, the hole-opening section of the exterior reamer body surface 36 may slope radially inwards along its length towards the downhole end, with a steeper (e.g. average) gradient or slope for the first opening group 28 than for the second opening group 30. There may be a marked change (e.g. a step change) in the gradient of exterior reamer body surface 36 with respect to the rotational axis 23 of the reamer between a portion of the hole-opening section carrying the first opening group 28 of cutters 26 and a portion of the hole-opening section carrying the second opening group 30 of cutters 26.

The difference in gradient between portions of the hole-opening section carrying the first opening group 28 of cutters 26 and the second opening group 30 of cutters 26 may provide a marked transition (e.g. step change) in the gradient of reamer body surface 36 with respect to the rotational axis 23 of the reamer at that point. There may be a similar marked transition (e.g. step change) in the gradient of reamer body surface 36 between a portion of the hole-opening section carrying the second opening group 30 of cutters 26 and a maintaining section of the exterior reamer body surface 36 carrying the maintaining group 32 of cutters 26.

Reamer profile is important, considering the limited space, associated geometric limitations and implications, from a product design standpoint.

The maintaining section of the reamer body surface 36, carrying the maintaining group 32 of cutters 26, may be parallel with the rotational axis 23, again as apparent from FIG. 3.

As such, the maintaining group 32 of cutters 26 may be configured to maintain a diameter of the hole that has been enlarged as the reamer 20 is moved down into the hole, in particular at a diameter (which has been) widened by the opening groups 28 and/or 30.

Cutters 26 of the maintaining group 32 may be disposed farthest from the rotational axis 23, and also further up the reamer's body/profile longitudinally, as they function to maintain the opened hole diameter.

The back reaming group 34 of cutters 26 is provided uphole from maintaining group 32. Back reaming group 34 may be configured to remove already drilled material/cuttings, collapsed formations, or stress relieved formation, while rotating and pulling the BHA 10 out of the hole. As such, a back-reaming section of the exterior reamer body surface 36 may be graded such that it slopes radially inwards along its length towards the uphole end. Put another way, a portion of exterior reamer body surface 36 carrying cutters 26 in the back reaming group 34 farthest from maintaining group 32 is closer to the rotational axis 23 than a portion of exterior reamer body surface 36 carrying cutters 26 in the back reaming group 34 that is adjacent to the maintaining group 32.

Taking row 25A of cutters 26, i.e. row A, as a running example, the various groups of cutters 26 as described above (first opening group 28, second opening group 30, maintaining group 32, and back-reaming group 34) may correspond to respective portions of the row 25 concerned, denoted with the same reference sign but with the suffix P to denote the corresponding row portion. For example, the first opening group 28 of cutters 26 may form a first opening portion 28P, the second opening group 30 a second opening portion 30P, the maintaining group 32 a maintaining portion 32P, and the back-reaming group 34 a back-reaming portion 34P.

Either one of the first opening and second opening portions, or both of the first opening and second opening portions collectively, may be referred to simply as a hole-opening portion for simplicity. To indicate this, the combination of the first opening and second opening groups of cutters is taken as a hole-opening group of cutters 40, and the corresponding portion is taken as a hole-opening portion 40P.

Of course, the groups of cutters 26 in the other rows 25, and the corresponding row portions, may be denoted in a similar way. Further, such groupings of cutters in a row and corresponding row portions may apply to each reamer block 24 of the reamer 20. As apparent from FIGS. 2 and 3, any one such portion or all such portions, or each row 25, may be considered to extend longitudinally along its reamer block 24, i.e. in a direction substantially parallel to the rotational axis 23.

It has been found that by providing cutters 26 on a given row 25, or across a set of rows, with an alternating pattern of feature values (e.g. a pattern which alternates radially/longitudinally, i.e. along the rows), overall durability and/or stability of the reamer 20 may be improved. This alternation of feature values will be considered next herein in connection with FIGS. 4A to 4C, 5, 6A, 6B, 7A, 7B and 8. It has also been found that providing independent coverage, optionally independent full zonal coverages, contributes to such performance improvement. Such independent coverages will be considered later in connection with FIGS. 9A, 9B, 10A to 10C, 11A to 11C and 12A to 12C.

This performance improvement encompasses enhanced failure/wear resistance, and improved cutting capabilities or other enhanced performances while maintaining proper weight distribution, appropriate torque response, and vibration control. This improvement in durability and/or stability leads to a reduction in failures and to longer runs and thus to reduced project cost.

For the benefit of further explanation, and assuming that the plurality of reamer blocks 24 are configured as in FIGS. 2 and 3 by way of example, the first rows 25A of cutters 26 across the reamer blocks 24 may be considered to constitute a set of rows of cutters. Similarly, the second rows 25B of cutters 26 across the reamer blocks 24 may be considered to constitute a set of rows of cutters. Similarly, the rows 25A, 25B of cutters 26 of a single reamer block 24 may be considered to constitute a set of rows of cutters.

Further, the reamer blocks 24 may be positioned longitudinally, and the row portions configured, so that corresponding row portions are longitudinally aligned. That is, the hole-opening portions 40P of the rows in a given set of rows (or for all sets of rows, or all rows 25) may span substantially the same longitudinal section of the reamer 20, i.e. are at the same "height" as one another where height is measured in the longitudinal direction. This longitudinal section of the reamer 20 may be referred to as a hole-opening section, region or zone. Similarly, the hole maintaining portions 32P of the rows in a given set of rows (or for all sets of rows, or all rows 25) may span substantially the same longitudinal section of the reamer 20. This longitudinal section of the reamer 20 may be referred to as a maintaining or hole-retention section, region or zone. Similarly, the back-reaming portions 34P of the rows in a given set of rows (or for all sets of rows, or all rows 25) may span substantially the same longitudinal section of the reamer 20. This longitudinal section of the reamer 20 may be referred to as a back-reaming section, region or zone. Of course, the reamer blocks 24 are positioned transversely (spatially/radially) apart from one another in the present arrangement e.g. as clear from FIG. 1), where the transverse direction follows the path of rotation of the reamer 20.

Figure 4A:
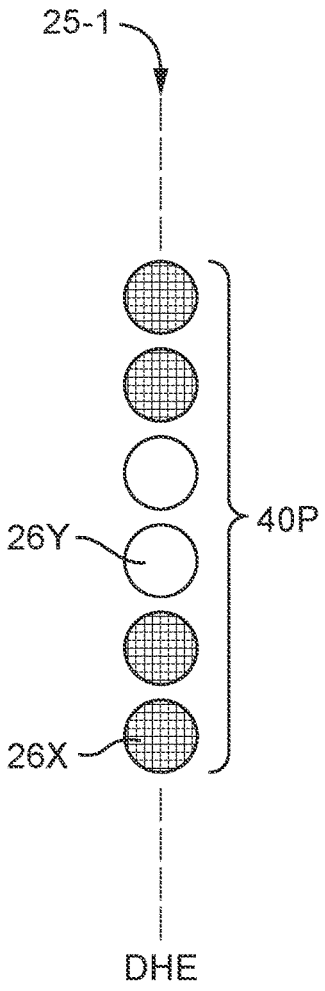
FIGS. 4A to 4C are schematic diagrams showing parts of three example rows of cutters, respectively, each having an alternating pattern of feature values.
Figure 4B:
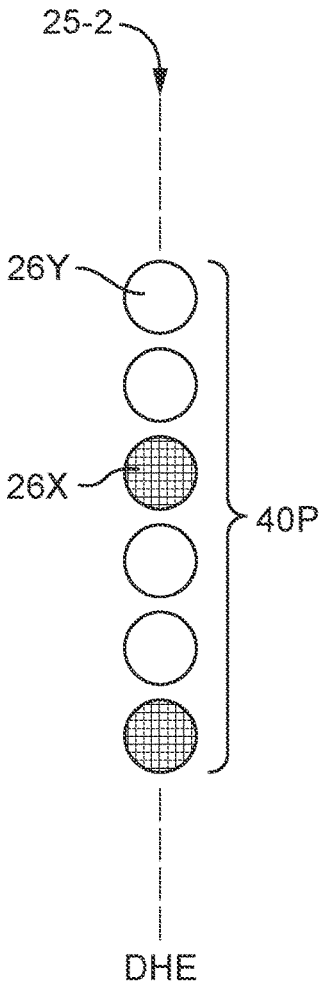
Figure 4C:
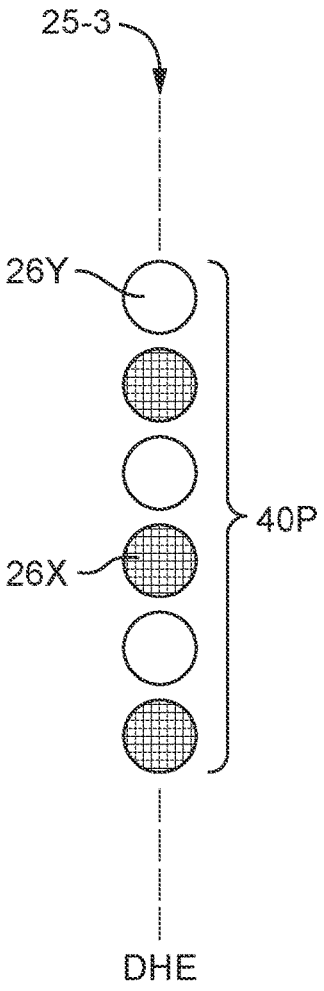

In order to explore the alternating pattern of feature values further, reference is made to FIGS. 4A to 4C, which are schematic diagrams showing parts of three example rows 25, labelled 25-1, 25-2 and 25-3, respectively. For each row, the cutters 26 are represented by circles. Further, the cutters 26 are indicated by shading as either being of type X (shaded), 26X, or of type Y (unshaded), 26Y.

It will be understood that only parts of the rows 25-1 to 25-3 are explicitly shown in each of FIGS. 4A to 4C, and in particular that those parts correspond to some or all of the hole-opening portions 40P of those rows. Six cutters 26 are shown for each of rows 25-1 to 25-3, simply by way of example. Focus will be placed on the hole-opening portions 40P of the rows going forwards, however it will be understood that similar considerations may apply to any or all of the other portions 28P, 30P, 32P, 34P (in combination, or individually) in some arrangements.

For a given design feature, it will be assumed that a cutter 26 is of type X, i.e. is a type X cutter 26X, if its value for that feature is within a first range, or is of type Y, i.e. is a type Y cutter 26Y, if its value for that feature is within a second range, where the first and second ranges are mutually different (e.g. non-overlapping ranges). In some arrangements, the first range comprises high values for the given design feature and the second range comprises low values for the given design feature, although the opposite may be true.

The different ranges may be significantly (or substantially) different so that values within the first range are significantly different from values in the second range. For example, it may be that values (e.g. average values) for a given design feature of type X cutters are at least 10% or 20% or 30% larger (or smaller) than for type Y cutters. For example, the difference may be 15% to 50% and preferably around 20%. Differences in feature values between different cutter types as described herein may be considered in a corresponding manner, such that the differences are significant.

As above, although FIGS. 4A to 4C focus on the hole-opening portions 40P of the rows concerned, they could be taken as focusing on the first opening portions 28P, or on the second opening portions 30P, or on the maintaining portions 32P, or on the back-reaming portions 34P. Indeed, the first opening portions 28P and the second opening portions 30P may be considered separately, as they may have different (specific) ranges of a given feature as will become more apparent later herein in connection with FIG. 8. Thus, to consider the first opening portions 28P and the second opening portions 30P together as the hole-opening portions 40P may be a simplification in some arrangements.

It may be that a type X cutter differs from a type Y cutter only in terms of the given design feature, although type X cutters may differ from type Y cutters in terms of multiple design features (parameters) as explored later herein.

The arrangement of type X and type Y cutters, 26X and 26Y, in each of rows 25-1 to 25-3 constitutes an alternating pattern, in that the cutters 26 alternate in type between type X and type Y along the length of the row portion concerned. In each case, the cutters 26 alternate along the given portion of the row between one or more type X cutters and one or more type Y cutters. Such arrangement may alternate (both) back and forth between type X and type Y cutters, in some arrangements repeatedly. For example, in at least one instance (or in multiple instances), a consecutive sequence of cutters comprises one or more type X cutters, one or more type Y cutters, and then one or more X cutters, or comprises one or more type Y cutters, one or more type X cutters, and then one or more Y cutters. The orders of cutter types in FIGS. 4A to 4C are examples, and may for example be reversed for any of the rows.

In row 25-1, the pattern shown alternates between a pair of type X cutters and a pair of type Y cutters, in row 25-2, the pattern shown alternates between a type X cutter and a pair of type Y cutters, and in row 25-3, the pattern shown alternates between a type X cutter and a type Y cutter, one cutter 26 to the next. These are of course just examples; other alternating patterns in any given row 25 are possible.

Further, although the patterns shown may be regular patterns (i.e. repeating patterns), irregular (non-repeating) patterns may also be provided.

As a concrete example, one given design feature is back rake, being an angle $\theta_{BR}$ subtended between a plane of a cutter face of the cutter 26 and a normal to the borehole wall or formation. In this regard, reference is made to FIG. 5, which is a schematic diagram useful for understanding back rakes in this context. It is noted at this juncture that the possibility of different average back rakes (as an example design feature) between type X cutters and type Y cutters, and a distribution of different averages along the profile (i.e. between the portions 28P, 30P, 32P, and potentially also 34P) is described later in connection with FIG. 8.

Figure 5:
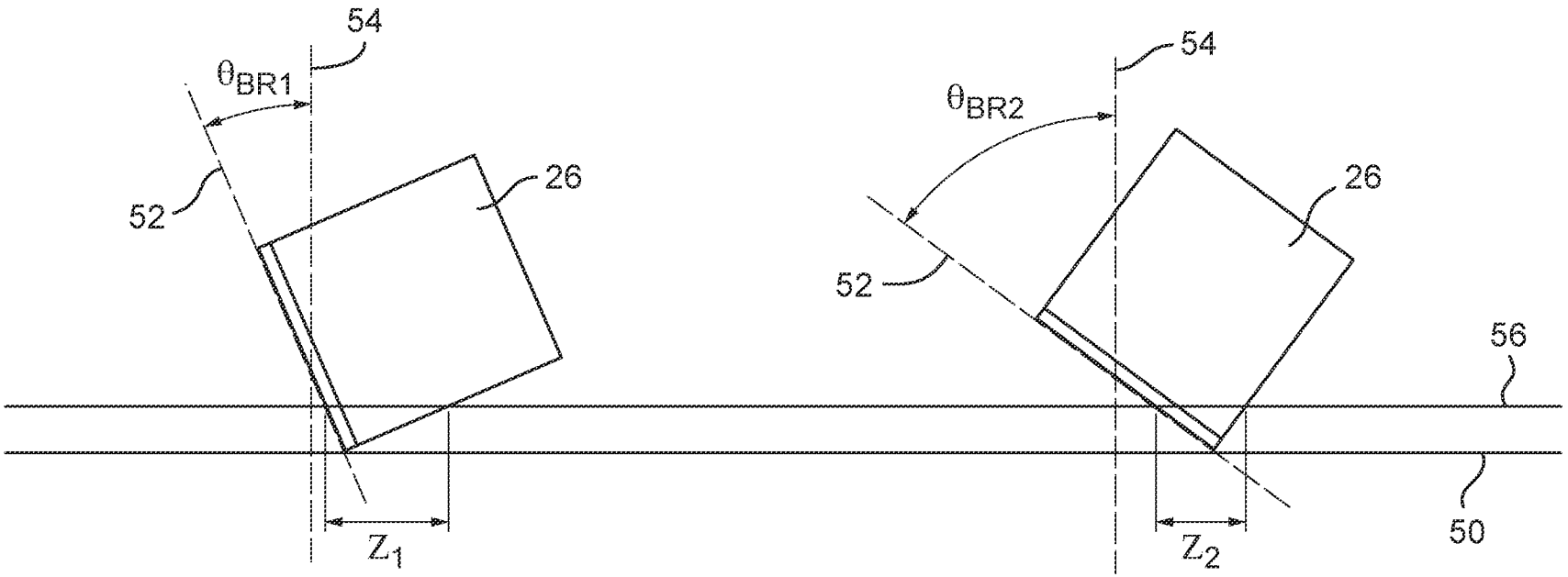
FIG. 5 is a schematic diagram useful for understanding back rakes.

FIG. 5 is a schematic diagram showing two example cutters 26, when viewed in the downhole direction, and engaging a borehole wall or the formation 50. For ease of comparison between the two example cutters 26, the borehole wall/formation 50 is indicated as a straight line and the cutters 26 are indicated as squares. Also shown, for both cutters 26, are the plane of the cutter face 52 and a normal 54 to the borehole wall/formation 50.

It can therefore be seen from FIG. 5 that the left-hand cutter 26 has a back rake angle $\theta_{BR1}$ and the right-hand cutter 26 has a back rake angle $\theta_{BR2}$. It can also be seen that the two cutters 26 have been shown to have different back rakes, in particular so that $\theta_{BR1}<\theta_{BR2}$.

In this context, and referring back to FIGS. 4A to 4C, the left-hand cutter 26 could be a type X cutter and the right-hand cutter 26 could be a type Y cutter for a given row portion, or vice versa, in terms of the design feature (parameter) back rake. In this context, and referring back to FIGS. 4A to 4C, for a given row portion the type X cutters have back rakes in one range (or the same as one another) and the type Y cutters have back rakes in another range (or the same as one another). Of course, averages may be referred to instead of ranges. As above, the averages may be at least 10% or 20% or 30% different. The difference may be 15% to 50% and preferably around 20%.

Figure 8:
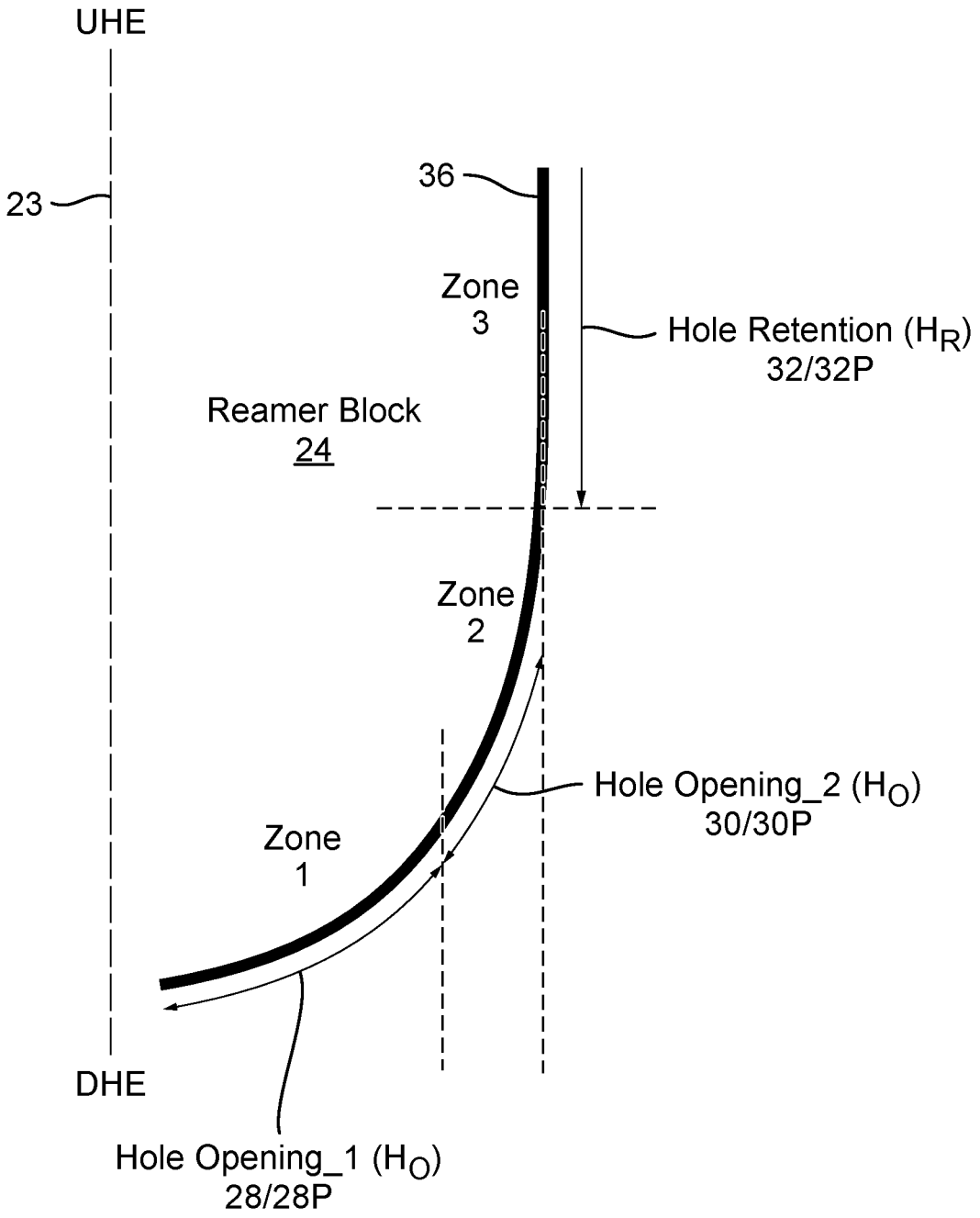
FIG. 8 is a schematic diagram useful for understating that design feature values or average values or ranges of values may be different in different zones or regions.

Recall that the first opening portions 28P and the second opening portions 30P may be considered separately, as they may have different (specific) ranges or averages of a given feature as will become more apparent later herein in connection with FIG. 8. Thus, the definition of a type X cutter in one row portion (e.g. 28P) may be different from that in another row portion (e.g. 30P). Similarly, the definition of a type Y cutter in one row portion (e.g. 28P) may be different from that in another row portion (e.g. 30P).

Also shown in FIG. 5 is a revised position 56 of the borehole wall/formation 50, relative to the cutters 26, after those cutters 26 have been worn in a drilling operation. As indicated, with the borehole wall/formation 50 in the revised position 56, the cutters 26 would have wear flats whose sizes are related to their back rakes. In particular, the left-hand cutter 26 has a back rake angle $\theta_{BR1}$ and a wear flat size $Z_1$, and the right-hand cutter 26 has a back rake angle $\theta_{BR2}$ and a wear flat size $Z_2$, where $\theta_{BR1}<\theta_{BR2}$ but $Z_1>Z_2$. That is, a large back rake leads to a smaller wear flat size, and vice versa.

Conventional thinking may teach that, for a given portion of a row 25, a particular back rake should be selected in common for all of the cutters 26 in order to provide a given performance. However, it has been found that improved performance, in particular improved durability and/or stability, is attained when the respective back rakes of the cutters alternate (or differ) along a given row portion, such as the hole-opening portion 40P, or each of the portions 28P, 30P and 32P (and even 34P) when considered separately, between one or more high back rakes and one or more low back rakes, in line with FIGS. 4A to 4C.

It is desirable to ensure efficient rock excavation, as discussed earlier, while establishing appropriate $WO_D$, $WO_B$, and $WO_R$ values and relationships with $TQ_D$, $TQ_B$ and $TQ_R$ that achieve efficient BHA functionality and reduced vibrations which contribute to dynamic and rapid reamer failures.

Higher back rakes require elevated applied weight (WO) values for rock exaction, a condition that challenges BHA design and functionality, with associated negative implications on performance. Lower back rakes require lower applied weight (WO) values, which is good for BHA functionality. However, lower back rakes can dictate compromising conditions for reamers, based on their design limitations and highly inefficient TQ vs WOB relationship, as discussed and established earlier with aggressiveness. Alternating back rakes longitudinally, where each group of back rake ranges establishes independent zonal coverages (as discussed in more detail later) achieves optimum or improved WO conditions, thereby enabling improved BHA and reamer functional efficiency, with regards to parameter requirements, relationships, behaviours and drilling dynamics.

Considering wear flat sizes as indicated in FIG. 5, a larger size of wear flat, such as size $Z_1$ in FIG. 5, will lead to a lower penetration rate, especially in harsher and harder formations, greater surface-area contact and resultant friction with the formation (leading to increased heat and wear) than a smaller size of wear flat, such as size $Z_2$ in FIG. 5. In this way, a cutter 26 with a tendency to have a larger wear flat size, such as the left-hand cutter 26 with the smaller back rake in FIG. 5, may wear faster (e.g. exponentially faster) than a cutter 26 with a tendency to have a smaller wear flat size, such as the right-hand cutter 26 with the larger back rake in FIG. 5. Differences in back rake thus lead to differences in wear flat sizes, drilling efficiencies, wear flat growth and heat levels, as well as affecting weight on reamer (WOR). By alternating the back rakes between high and low values along a given row portion, the development of such wear flats is different between cutters as a function of the different back rakes, leading to loading and work rate differences (which are spatially distributed). As a result, overall durability and/or stability is improved.

Another example design feature is cutter geometry, in particular the geometry of the cutter face of the cutter 26. It will be appreciated that the geometry of the cutter face could be measured is several different ways, such as by reference to size, surface area, perimeter and major/minor axes.

Figure 6A:
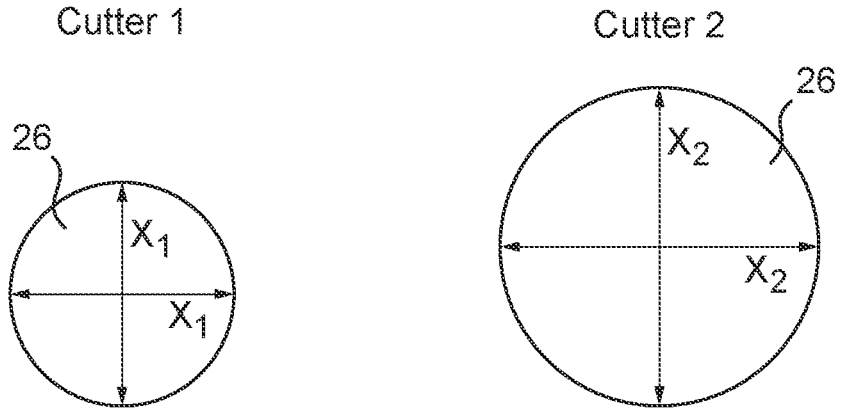
FIGS. 6A and 6B are schematic diagrams useful for understanding cutter sizes and geometries.
Figure 6B:
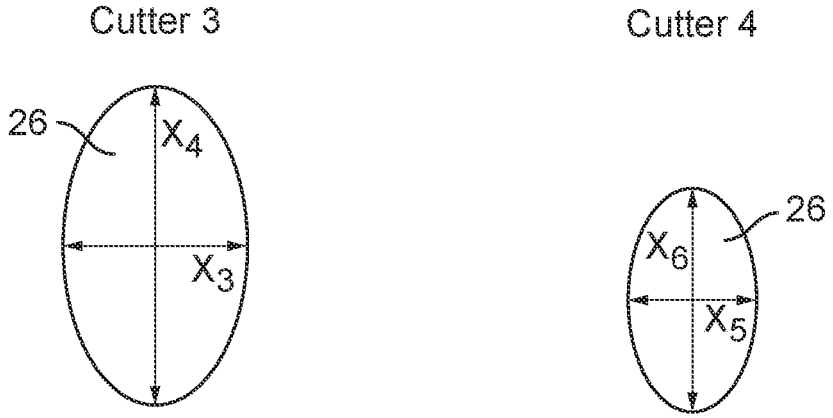

In this regard, reference is made to FIGS. 6A and 6B, which are schematic diagrams useful for understanding cutter geometry in this context, and in particular major and minor axes which at least in part define cutter geometry.

FIG. 6A is a schematic diagram showing two example cutters 26 (Cutters 1 and 2), as if viewing their cutter faces perpendicularly (face on). For ease of comparison between the two cutters 26, the relative sizes of major and minor axes of the cutter faces have been indicated, where in this case the major axis is vertical and the minor axis is horizontal in the orientation shown. FIG. 6B is a schematic diagram showing a further two example cutters 26 (Cutters 3 and 4), as if viewing their cutter faces perpendicularly (face on).

As above, the major and minor axes may be taken as example features which (at least in part) define the overall feature cutter geometry. The geometry of the cutter face could be defined by any or all of sub-features cutter size, surface area, perimeter and major/minor axes. Any of surface area, perimeter and major/minor axes may be taken to define cutter size.

It may be understood that two cutter geometries are different when any (one) of these sub-features are different between the geometries. The differences in major/minor axes shown in FIGS. 6A and 6B are thus just examples.

It will be appreciated that the cutters 26 may be defined by other design features, for example any of shape, composition, surface area extending from its reamer block 24, volume extending from its reamer block 24, height extending from its reamer block 24 (cutter exposure), extension from the external reamer body surface 36 of its reamer block 24, length of cutting edge, cross sectional area, diamond area/volume, overall volume, and geometric cross-sectional shape.

Figure 7A:
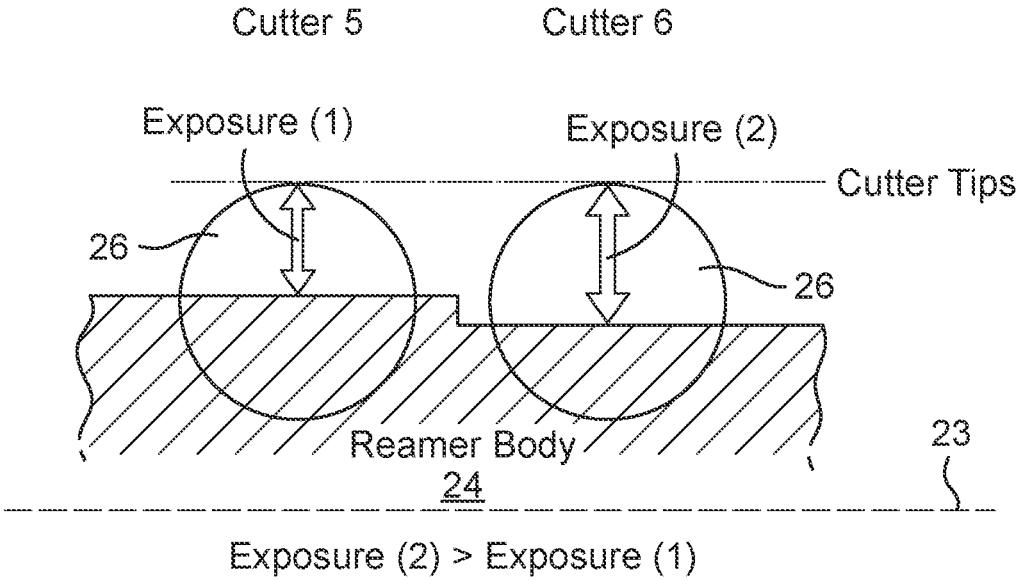
FIGS. 7A and 7B are schematic diagrams useful for understanding cutter exposure.
Figure 7B:
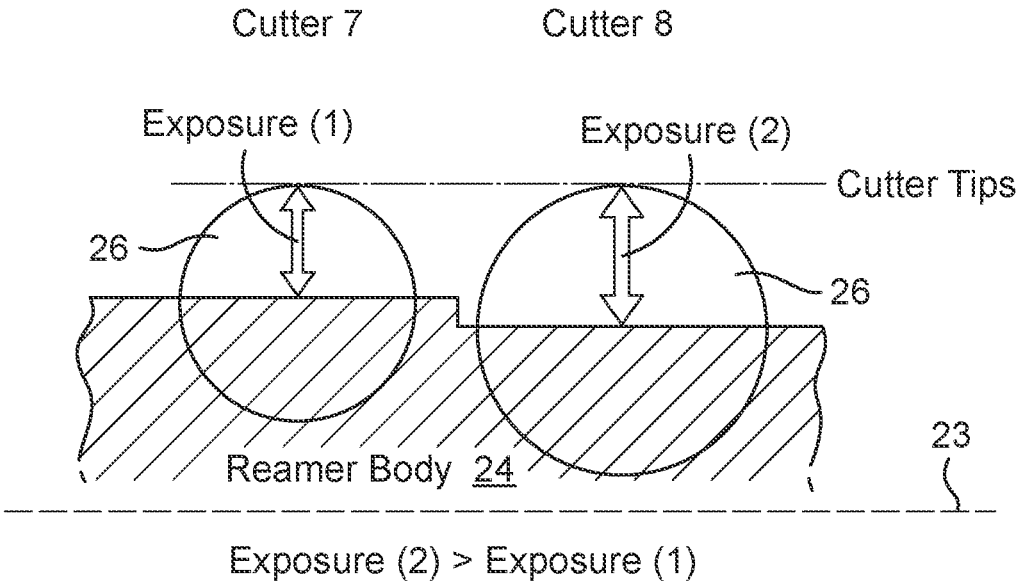

Considering cutter exposure as an example, reference is made to FIGS. 7A and 7B, which are schematic diagrams useful for understanding cutter exposure.

FIG. 7A is a schematic diagram showing two example cutters 26 (Cutters 5 and 6), as mounted in a reamer body or block 24 with their cutter tips at the same level or height from the rotational axis 23 as indicated. For ease of comparison between the two cutters 26, the relative sizes of their exposures (height of cutter tip from reamer body) have been indicated. FIG. 7B is a schematic diagram showing a further two example cutters 26 (Cutters 7 and 8). For ease of comparison between the two cutters 26, the relative sizes of their exposures have been indicated.

In FIG. 7A, the two cutters (Cutters 5 and 6) have the same cutter sizes, their cutter tips at the same level or height from the rotational axis 23, but different exposures. In FIG. 7B, the two cutters (Cutters 7 and 8) have different cutter sizes, their cutter tips at the same level or height from the rotational axis 23, and different exposures.

Other example design features include impact and abrasion properties, and diamond table thickness. The skilled person will be aware of other design features which may be used to define the cutters.

It may be understood that two cutters 26 are different in configuration when any (one) of their design features are different.

With all of the above in mind, and referring back to FIGS. 4A to 4C, any of Cutters 1 to 4 (see FIGS. 6A and 6B) could be a type X cutter and any other of Cutters 1 to 4 could be a type Y cutter, or vice versa, in terms of the design feature cutter geometry. For example, in terms of cutter face surface area or perimeter, Cutters 2 and 3 could be type X cutters and Cutters 1 and 4 could by type Y cutters, or vice versa. Similarly, Cutter 5 (see FIG. 7A) could be a type X cutter and Cutter 6 could be a type Y cutter, or vice versa, in terms of the design feature cutter exposure.

In general, e.g. in addition to differences in back rake, the type X cutters may have a further cutter design feature in one range (or the same as one another) and the type Y cutters may have that further cutter design feature in another range (or the same as one another).

Taking just the back rake and cutter size design features for example, as example first and second design features (or simply, features), respectively, it will be apparent that multiple arrangements are possible. Of course, similar considerations apply to other example first and second features.

In a first scenario, and considering a particular row portion by way of example, the alternating pattern between type X and Y cutters may be the same for both features. In this case, the type X cutters may have a large back rake (first feature) and a large cutter size (second feature), and the type Y cutters may have a small back rake (first feature) and a small cutter size (second feature), or vice versa. As another option, the type X cutters may have a large back rake (first feature) and a small cutter size (second feature), and the type Y cutters may have a small back rake (first feature) and a large cutter size (second feature), or vice versa.

In another scenario, and again considering a particular row portion by way of example, the alternating pattern between cutters may be different for the different features. In this case, the type X cutters may have a large back rake (first feature), and the type Y cutters may have a small back rake (first feature), or vice versa, as before where the typing between X and Y relates to back rake specifically. However, the same cutters may also be divided into type Q and type R cutters, in terms of cutter size (second feature). In this case, the type Q cutters may have a large cutter size (second feature), and the type R cutters may have a small cutter size (second feature), or vice versa. The pattern of types Q and R may be an alternating pattern akin to those shown in FIGS. 4A to 4C, but as above the pattern between types Q and R (second feature, cutter size) may be different from the pattern between types X and Y (first feature, back rake). This may lead, for example, to some cutters having a large back rake and large cutter size, and some cutters having a large back rake and a small cutter size, in the same row portion.

As mentioned earlier, the portions 28P, 30P, 32P, 34P may be considered separately, and may have different (specific) ranges of a given feature. In this regard, reference is made to FIG. 8 which is a schematic diagram showing the exterior reamer body surface 36 of the reamer block 24 relative to the rotational axis 23, for a given point in the path of rotation. Also shown are example boundaries between the first opening zone 28 (corresponding to the first opening portion 28P), the second opening zone 30 (corresponding to the second opening portion 30P), and the maintaining group 32 (corresponding to the maintaining portion 32P). These zones have been labelled Zones (or regions) 1 to 3 for simplicity. Consideration of the back-reaming group 34 (corresponding to the back-reaming portion 34P) is omitted here for simplicity.

Taking the design feature of back rake as an example design feature, the back rakes may alternate along the longitudinal profile of the reamer block 24 (i.e. along a row 25 of cutters 26) as mentioned earlier. This may occur in each of Zones 1 to 3, or in any one of them.

For those Zones in which back rakes alternate, there may be two distinct back rake groups (corresponding to type X and Y cutters, respectively) for each Zone. For example, for each of those Zones, there may be a first average back rake for a first back rake group (e.g. corresponding to type X cutters) and a second average back rake for a second back rake group (e.g. corresponding to type Y cutters). As above, the averages (or values themselves) may be at least 10% or 20% or 30% different between different types. The difference may be 15% to 50% and preferably around 20%.

For those Zones in which back rakes alternate, there may be different ranges of back rake across the Zones. For example, in Zone 1 (first opening zone), the average back rake difference between the first and second back rake groups may be 10 to 25 degrees, preferably 15 to 25 degrees. In Zone 2 (second opening zone), the average back rake difference between the first and second back rake groups may be 5 to 20 degrees, preferably 10 to 15 degrees. In Zone 3 (maintaining or hole retention zone), the average back rake difference between the first and second back rake groups may be 0 to 15 degrees, preferably 5 to 10 degrees. Put another way, the difference in (average) back rake between type X and type Y cutters may be most big in Zone 1, less big in Zone 2, and even less big in Zone 3.

Similar considerations apply to other design features, with back rake taken simply as an example.

Returning to FIGS. 4A to 4C, and focusing on the types X and Y for simplicity, it has been found as mentioned earlier that, as well as providing an alternating pattern of types, it is desirable for each of types X and Y to provide 'independent coverage' or 'full zonal coverage' independently (i.e. independent coverages) for the row portion concerned, e.g. the hole-opening portion 40P in FIGS. 4A to 4C (but any of portions 28P, 30P, 32P, 34P in general). This full zonal coverage may be provided by a set of rows 25 on the same reamer block 24, or by a set of rows distributed across reamer blocks 24 (such as a set comprising the first row 25A of each reamer block 24). Incidentally, FIGS. 4A, 4B, and 4C only show variants of how alternate cutter types can be deployed for different rows (e.g. on different reamer blocks). These Figures as presented do not show full and independent zonal coverages.

The concept of 'independent coverage' or 'full zonal coverage' may be taken here to mean that, for a given cutter type (e.g. type X) and a given set of rows 25, the cutters of that type span (e.g. collectively cover, preferably with at least partial overlap and thus without a gap between cutter paths) the longitudinal section of the reamer occupied by the row portions concerned, and independently (i.e. of a different cutter type, such as type Y).

Taking type X cutters as an example, looking at the shaded cutters 26X in FIG. 4C, it is recalled that those cutters are not all adjacent to one another in a given row such as row 25-3 (because some of the cutters 26 in that row are type Y cutters, 26TY). However, when the rows 25 of a set of rows 25 are taken into account together, the type X cutters may be arranged so that together they span the longitudinal section of the reamer occupied by the hole-opening portion 40P (the hole-opening zone). That is, cutter paths through which the respective type X cutters pass as the reamer 20 is rotated may be mutually substantially adjacent and at least partially overlap in the longitudinal direction.

Similarly, for that set of rows 25, the type Y cutters may be arranged so that together they span the longitudinal section of the reamer occupied by the hole-opening portion 40P.

That is, cutter paths through which the respective type Y cutters pass as the reamer 20 is rotated may also be mutually substantially adjacent and at least partially overlap in the longitudinal direction. In this sense, the different cutter types X and Y, based on the differentiating element or condition, achieve full and independent zonal coverages in this zone.

Figure 9B:
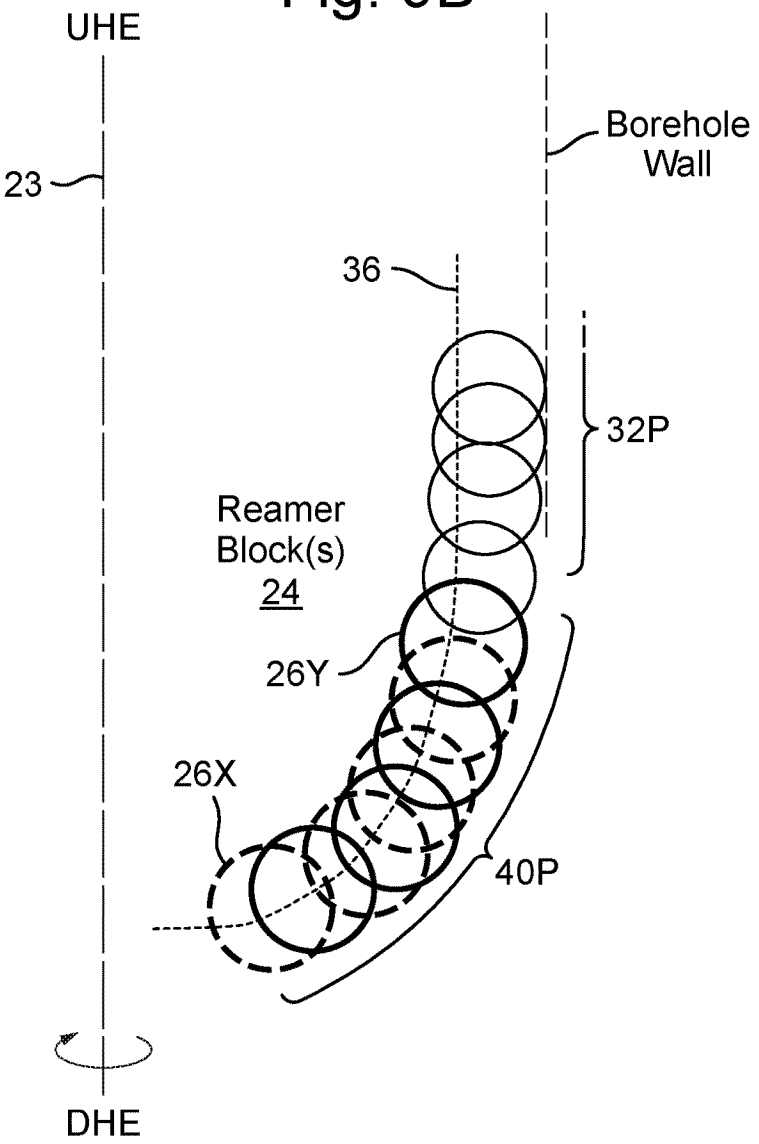
FIGS. 9A and 9B are schematic diagrams useful for understanding the concepts of full and independent zonal coverage.
Figure 9A:
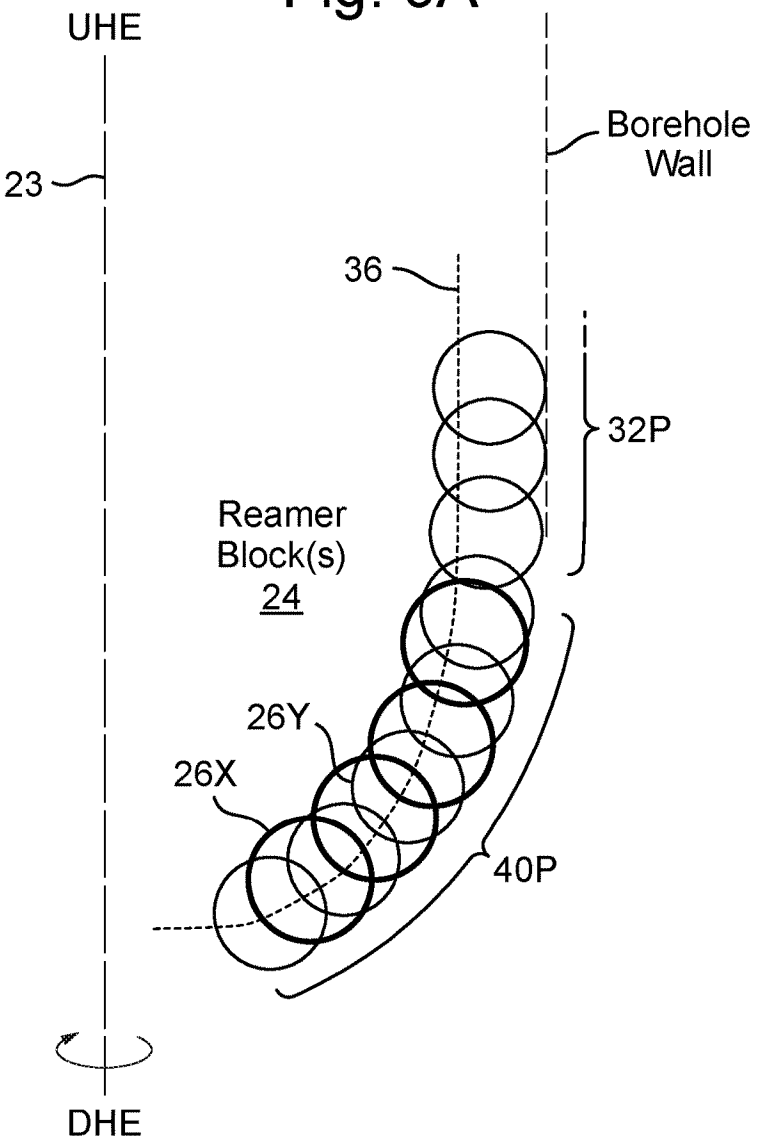

FIGS. 9A and 9B are schematic diagrams useful for better understanding the concepts of full zonal coverage and independent coverage (in combination, full zonal and independent coverage), here shown in particular for the hole-opening portions 40P of a given set of rows 25 (occupying the hole-opening zone) as an example. Recall that a set of rows 25 may comprise a plurality of rows on the same reamer block 24, or a plurality of rows distributed across reamer blocks 24 (such as the first row 25A of each reamer block 24). A set of rows 25 may be considered to comprise at least two, or at least three, rows 25.

In each of FIGS. 9A and 9B, the position of the exterior reamer body surface 36 of the reamer block 24 or reamer blocks 24 concerned is shown relative to the rotational axis 23, for a given point in the path of rotation. The paths of the cutters 26X and 26Y are then shown as circles for simplicity, indicating that a cutter of that type passes through (and occupies the space of) that circle as the reamer 20 is rotated in the drilling operation (i.e. when the cutters are rotated about the rotational axis 23 a single point on a cutter remains in a transverse plane, being a plane which is perpendicular to the rotational axis 23). Put another way, FIGS. 9A and 9B show how the cutter paths of the cutters 26X and 26Y intersect a single radial plane—being a plane which ends radially from the rotational axis 23, at a given angle of rotation about the rotational axis 23, and longitudinally.

In FIG. 9A, the paths of type X cutters are indicated by circles drawn with thick lines and the paths of type Y cutters are indicated by circles drawn with thin lines. In FIG. 9B, the paths of type X cutters are indicated by circles drawn with thick dashed lines and the paths of type Y cutters are indicated by circles drawn with thick continuous lines. In both cases, the paths of cutters in the maintaining portions 32P are also shown, indicated by circles drawn with thin lines.

As can be seen from FIG. 9A, the paths of the cutters 26X of a set of rows (although not overlapping when considering a single row 25 as clear from FIG. 4) partially overlap one to the next across the hole-opening portions 40P. Similarly, the paths of the cutters 26Y of a set of rows (although not overlapping when considering a single row 25 as clear from FIG. 4) partially overlap one to the next across the hole-opening portions 40P.

The same is true for FIG. 9B. The difference between FIGS. 9A and 9B, however, is in relation to cutter size (as an example second design feature), with the sizes of the circles here intended to indicate cutter size. Therefore, FIG. 9A shows an example where the type X cutters have a larger cutter size than the type Y cutters, with the cutters 26 in the maintaining portions 32P having the same cutter size as the type Y cutters. FIG. 9B shows an example where the type X cutters and the type Y cutters have the same cutter size (or cutter sizes in the same range of sizes), with the cutters 26 in the maintaining portions 32P having smaller cutter sizes. It is also assumed here, as before, that the type X cutters have back rakes in one range of back rakes (or substantially the same back rakes as one another) and that the type Y cutters have back rakes in a different range of back rakes (or substantially the same back rakes as one another), so that the type X and Y cutters have back rakes in different ranges and/or different back rakes from one another. As before, averages may be considered instead of ranges.

A number of arrangements will now be detailed, assuming merely for simplicity that in a given arrangement the type X cutters are configured substantially the same as one another, and the type Y cutters are configured substantially the same as one another.

A first arrangement is in line with FIG. 9A. In this arrangement, in the hole opening zone or section of the reamer 20 corresponding to the hole-opening portions 40P of a set of rows 25, the type X cutters have a high back rake and a large cutter size, and the type Y cutters have a low back rake and a small cutter size. The type X and type Y cutters may have different geometries (beyond differences due to cutter size). The type X cutters have full zonal coverage and the type Y cutters also (independently of the type X cutters) have full zonal coverage, and the set of rows 25 comprises at least two or three rows 25. In this arrangement, in the maintaining (hole retention) zone or section of the reamer 20 corresponding to the maintaining portions 32P of the set of rows 25 concerned, the cutters 26 either have the same or similar cutter sizes as one another or have mutually different cutter sizes (for example in an alternating pattern). Similarly, in the maintaining (hole retention) zone or section of the reamer 20 for the set of rows 25 concerned, the cutters 26 either have the same or similar back rakes as one another or have mutually different back rakes (for example in an alternating pattern).

A second arrangement, also in line with FIG. 9A, is based on the first arrangement and differs from the first arrangement in that the type X cutters have a high back rake and a small cutter size, and the type Y cutters have a low back rake and a large cutter size. The type X and type Y cutters may have different geometries (beyond differences due to cutter size). The type X cutters have full zonal coverage and the type Y cutters also have full zonal coverage, and the set of rows 25 comprises at least two or three rows 25. In this arrangement, in a maintaining (hole retention) zone or section of the reamer 20 corresponding to the maintaining portions 32P of the set of rows 25 concerned, the cutters 26 either have the same or similar cutter sizes as one another or have mutually different cutter sizes (for example in an alternating pattern). Similarly, in the maintaining (hole retention) zone or section of the reamer 20 for the set of rows 25 concerned, the cutters 26 either have the same or similar back rakes as one another or have mutually different back rakes (for example in an alternating pattern).

A third arrangement is in line with FIG. 9B. In this arrangement, in a hole opening zone or section of the reamer 20 corresponding to the hole-opening portions 40P of a set of rows 25, the type X cutters have a high back rake and the type Y cutters have a low back rake. The type X cutters have full zonal coverage and the type Y cutters also have full zonal coverage, and the set of rows 25 comprises at least two or three rows 25. Also, the type X and type Y cutters have substantially the same cutter size as one another. In this arrangement, in a maintaining (hole retention) zone or section of the reamer 20 corresponding to the maintaining portions 32P of the set of rows 25 concerned, the cutters 26 either have the same or similar cutter sizes as one another or have mutually different cutter sizes (for example in an alternating pattern). Similarly, in the maintaining (hole retention) zone or section of the reamer 20 for the set of rows 25 concerned, the cutters 26 either have the same or similar back rakes as one another or have mutually different back rakes (for example in an alternating pattern).

A fourth arrangement, also in line with FIG. 9B, differs from the third arrangement in that the type X cutters have a low back rake and the type Y cutters have a high back rake. The type X cutters have full zonal coverage and the type Y cutters also (independently) have full zonal coverage, and the set of rows 25 comprises at least two or three rows 25. In this arrangement, in a maintaining (hole retention) zone or section of the reamer 20 corresponding to the maintaining portions 32P of the set of rows 25 concerned, the cutters 26 either have the same or similar cutter sizes as one another or have mutually different cutter sizes (for example in an alternating pattern). Similarly, in the maintaining (hole retention) zone or section of the reamer 20 for the set of rows 25 concerned, the cutters 26 either have the same or similar back rakes as one another or have mutually different back rakes (for example in an alternating pattern).

Figure 10C:
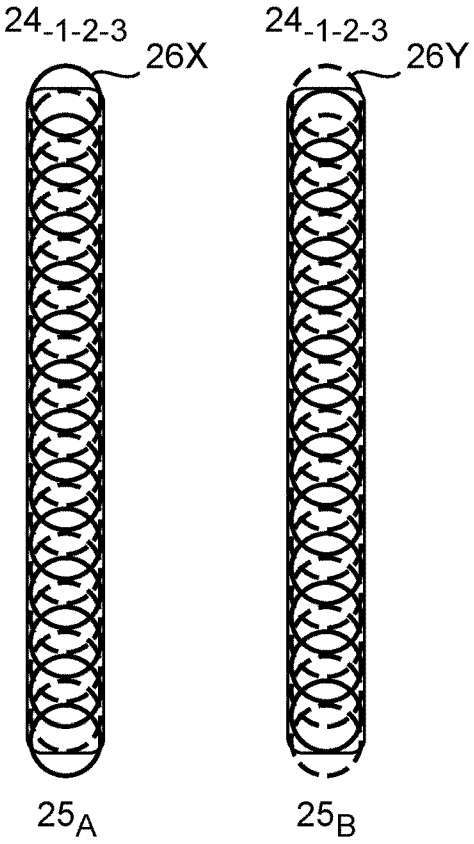
FIGS. 10A to 10C are schematic diagrams useful for understanding the concepts of full and independent zonal coverage.
Figure 10B:
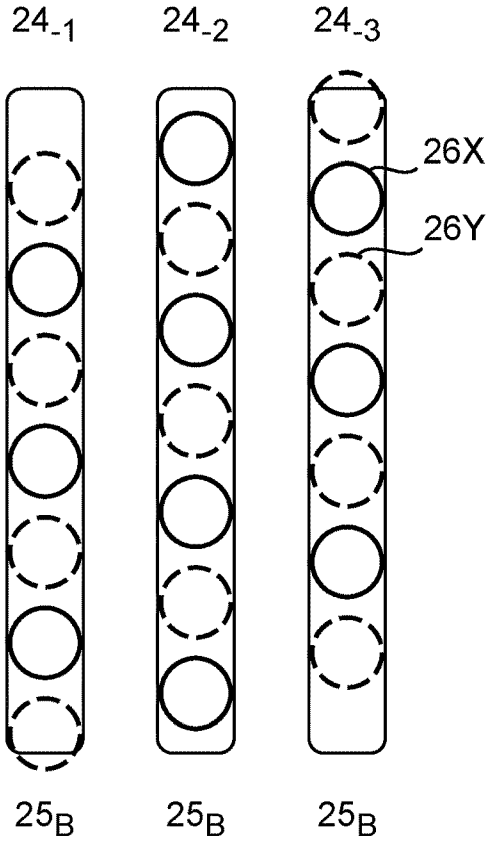
Figure 10A:
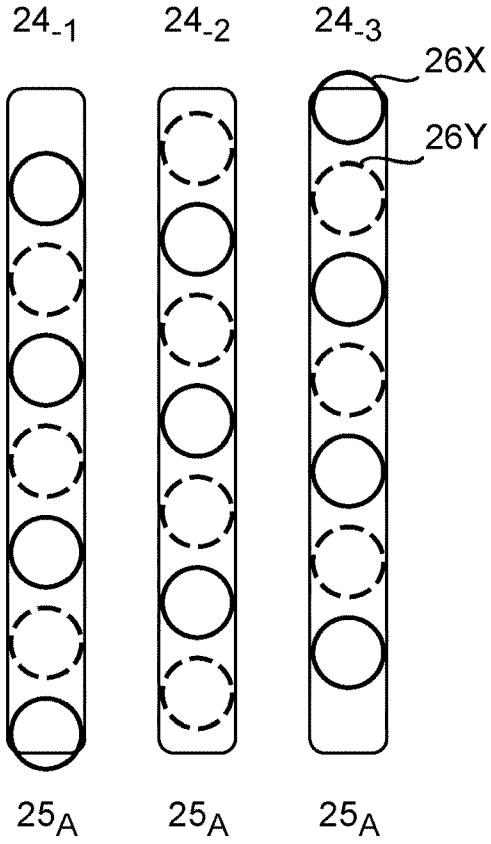

FIGS. 10A to 10C are schematic diagrams useful for appreciating that the concepts of full zonal coverage and independent coverage may be dealt with on a set-by-set basis, i.e. considering different sets of rows 25 one by one.

Three reamer blocks $\mathbf{24}_{-1}$, $\mathbf{24}_{-2}$ and $\mathbf{24}_{-3}$ are shown schematically as rectangles, and are positioned side-by-side in FIGS. 10A and 10B to indicate that they are mounted on the elongate body 22 of the reamer 20 at substantially the same longitudinal position (i.e. at the same position in the downhole direction). Each of the reamer blocks $\mathbf{24}_{-1}$ to $\mathbf{24}_{-3}$ is shown having a first row 25A and a second row 25B of cutters 26, in line with FIGS. 2 and 3. Moreover, in line with FIGS. 4A to 4C, the cutters are shown schematically as circles, and are marked to indicate whether they are type X or type Y cutters, 26X and 26Y. The cutters shown similarly correspond to part or all of the hole-opening portions 40P of the rows concerned (or to any of portions 28P, 30P, 32P, 34P as mentioned earlier), and alternating patterns of type X and type Y cutters are shown in line with row 25-3 of FIG. 4C as an example.

Here, groups of seven cutters are shown per row for simplicity, however this is just an example. Also, as an example, it is assumed that type X and Y cutters differ in terms of back rake (as an example first design feature), and potentially also in terms of a second design feature such as cutter size. It is further assumed here that the first rows 25A of the reamer blocks $\mathbf{24}_{-1}$ to $\mathbf{24}_{-3}$ constitute a first set of rows, and that the second rows 25B constitute a second set of rows.

FIG. 10A relates to the first set of rows 25A and FIG. 10B relates to the second set of rows 25B. FIG. 10C shows, on the left, the first set of rows 25A for the reamer blocks $\mathbf{24}_{-1}$ to $\mathbf{24}_{-3}$ (hence $\mathbf{24}_{-1-2-3}$) superimposed on one another to help show the adjacent longitudinal overlaps and full zonal coverage for the first set of rows 25A, and, on the right, similarly the second set of rows 25B for the reamer blocks $\mathbf{24}_{-1}$ to $\mathbf{24}_{-3}$ superimposed on one another to help show the adjacent longitudinal overlaps and full zonal coverage for the second set of rows 25B.

Focusing firstly on the first set of rows 25A and FIG. 10A, the cutters which are shown have been positioned longitudinally relative to one another between the different rows 25A so that the type X cutters have full zonal coverage as indicated in FIG. 10C. It can be appreciated that the type Y cutters also have full zonal coverage (independent from the coverage of the type X cutters).

Focusing secondly on the second set of rows 25B and FIG. 10B, the cutters which are shown have been positioned longitudinally relative to one another between the different rows 25B so that the type X cutters have full zonal coverage as indicated in FIG. 10C. The type Y cutters also have full zonal coverage (independent from the coverage of the type X cutters).

Although back rake and cutter size are two design features focused on above, other design parameters may be considered such as mentioned earlier. The present disclosure will be understood accordingly.

Figure 11C:
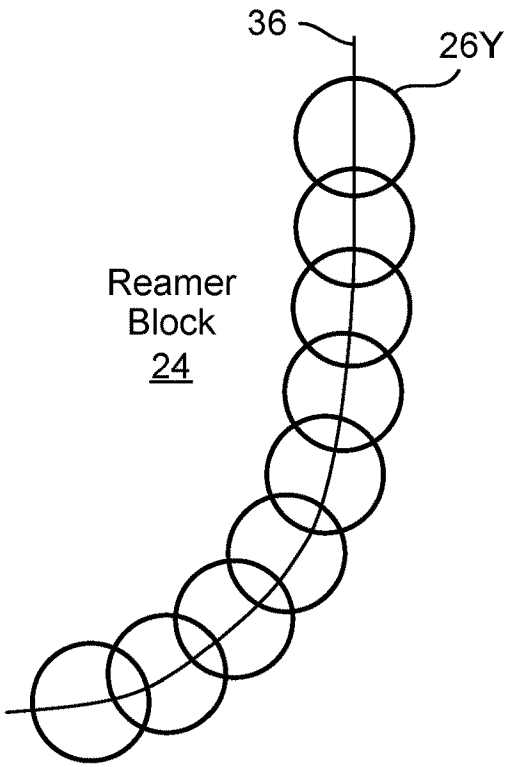
FIGS. 11A to 11C are schematic diagrams useful for understanding the concepts of full and independent zonal coverage.
Figure 11B:
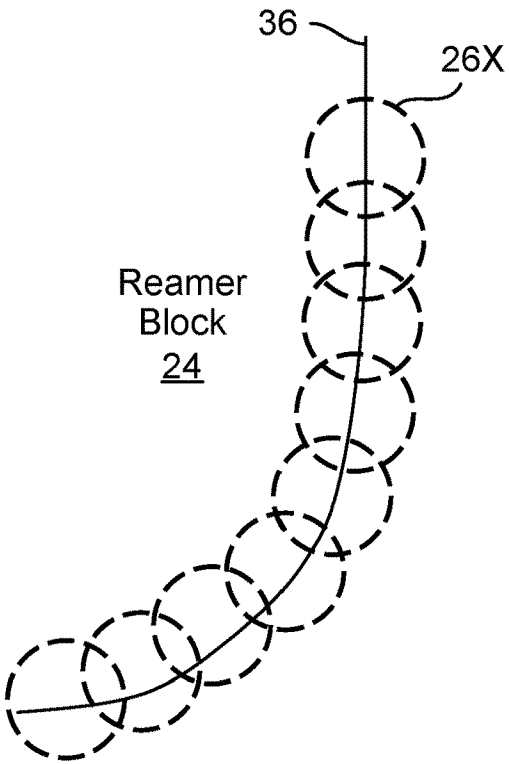
Figure 11A:
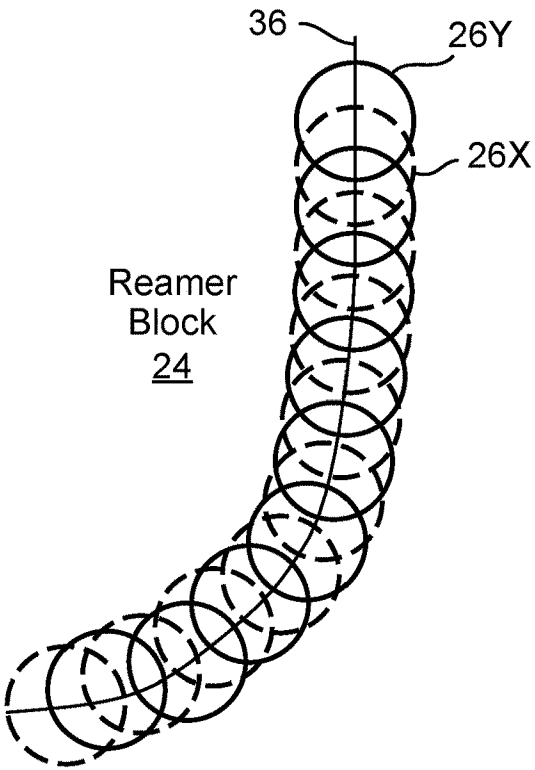

For example, FIGS. 11A to 11C (similar to FIGS. 9A and 9B) are schematic diagrams useful for further understanding the concept of full and independent zonal coverage. Recall that a set of rows 25 may comprise a plurality of rows on the same reamer block 24, or a plurality of rows distributed across reamer blocks 24 (such as the first row 25A of each reamer block 24). A set of rows 25 may be considered to comprise at least two, or at least three, rows 25.

In each of FIGS. 11A to 11C, the position of the exterior reamer body surface 36 of the reamer block 24 or reamer blocks 24 concerned is shown, for a given point in the path of rotation. The paths of the cutters 26X and 26Y are then shown as circles for simplicity, indicating that a cutter of that type passes through (and occupies the space of) that circle as the reamer 20 is rotated in the drilling operation.

In FIG. 11A, the paths of type X cutters, 26X, and type Y cutters, 26Y, are shown together, whereas FIG. 11B relates only to the type X cutters, 26X, and FIG. 11C relates only to the type Y cutters, 26Y.

As can be seen from FIG. 11B, the paths of the cutters 26X of a set of rows (although not overlapping when considering a single row 25 as clear from e.g. FIG. 4C) overlap one to the next. These groups of cutters establish full and independent zonal coverage, when all 26Y cutters are absent or removed in this zone. Similarly, as seen in FIG. 11C, the paths of the cutters 26Y of a set of rows (although not overlapping when considering a single row 25 as clear from e.g. FIG. 4C) overlap one to the next. These groups of cutters also establish full and independent zonal coverage, when all 26X type cutters are absent or removed in this zone.

Here it is assumed that the type X and Y cutters differ in terms of back rake as an example first design feature, and that they have the same cutter size as an example second design feature. The back rakes form an alternating pattern along the rows as mentioned earlier. Note that the independent and full coverages are provided for both the hole-opening and maintaining/hole-retention zones. Potential differences between those zones have been omitted for simplicity.

It may be that different cutter properties are provided as another example second design feature or as a third design feature (between the type X and Y cutters, or in another alternating pattern). Such properties may include impact vs. abrasion resistance properties and/or diamond table thicknesses.

Figure 12A:
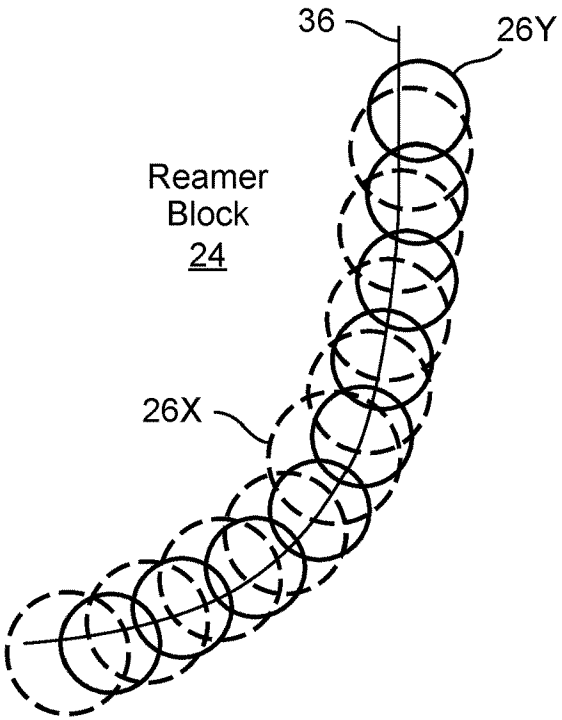
FIGS. 12A to 12C are schematic diagrams useful for understanding the concepts of full and independent zonal coverage.
Figure 12B:
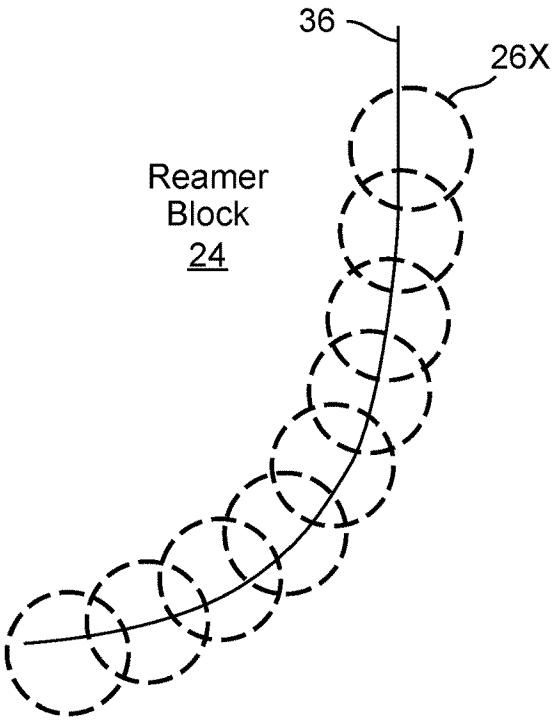
Figure 12C:
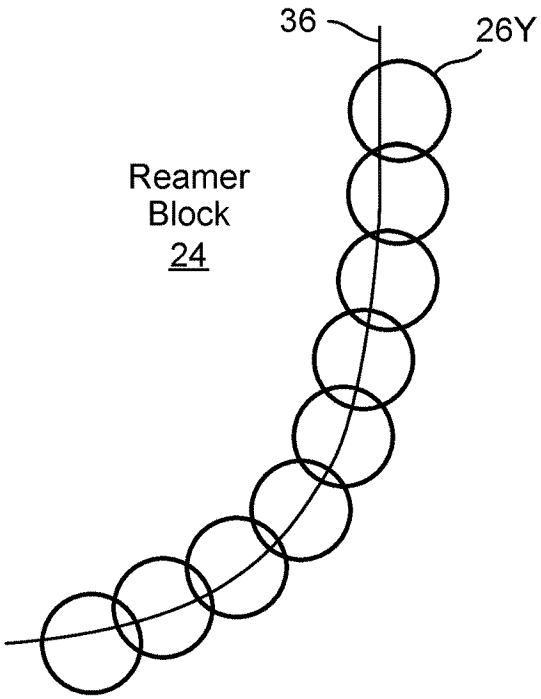

FIGS. 12A to 12C correspond to FIGS. 11A to 11C, respectively, and are schematic diagrams useful for further understanding the concept of full zonal coverage.

In each of FIGS. 12A to 12C, the position of the exterior reamer body surface 36 of the reamer block 24 or reamer blocks 24 concerned is shown, for a given point in the path of rotation. The paths of the cutters 26X and 26Y are then shown as circles for simplicity, indicating that a cutter of that type passes through (and occupies the space of) that circle as the reamer 20 is rotated in the drilling operation.

In FIG. 12A, the paths of type X cutters, 26X, and type Y cutters, 26Y, are shown together, whereas FIG. 12B relates only to the type X cutters, 26X, and FIG. 12C relates only to the type Y cutters, 26Y.

As can be seen from FIG. 12B, the paths of the cutters 26X of a set of rows (although not overlapping when considering a single row 25 as clear from e.g. FIG. 4C) overlap one to the next. Similarly, as seen in FIG. 12C, the paths of the cutters 26Y of a set of rows (although not overlapping when considering a single row 25 as clear from e.g. FIG. 4C) overlap one to the next.

Here it is assumed that the type X and Y cutters differ in terms of back rake as an example first design feature, and that they have different cutter sizes as an example second design feature (defined by any of size, area, circumference, major axis, minor axis). The back rakes form an alternating pattern along the rows as mentioned earlier. Note that the independent and full coverage is provided for both the hole-opening and maintaining/hole-retention zones. Potential differences between those zones have been omitted for simplicity.

It may be that different cutter properties are provided as a third design feature (between the type X and Y cutters, or in another alternating pattern). Such properties may include impact vs. abrasion resistance properties and/or diamond table thicknesses.

It will be appreciated that embodiments of the present invention enable durability and/or stability improvements. Embodiments of the present invention enable (particularly in the hole-opening zone/section, i.e. at the hole-opening portions 40P) reduced wear flat sizes at comparable dull grades, delayed wear growth, increased diamond content, appropriate weight on reamer ($WO_R$), efficient torque (TQ) response and improved stability characteristics. At the hole retention zone/section (corresponding to the maintaining portions 32P), embodiments address torque trends and susceptibility to vibrations, while improving durability and enhancing hole retention characteristics It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in the claim, "a" or "an" does not exclude a plurality, and a single feature or other unit may fulfil the functions of several units recited in the claims. Any reference numerals or labels in the claims shall not be construed so as to limit their scope.

As used herein, when two or more elements are referred to as "coupled" to one another, such term indicates that such two or more elements are in mechanical communication, for example permanently or removably attached as applicable, whether connected indirectly or directly, with or without intervening elements.

This disclosure encompasses all changes, substitutions, variations, alterations, and modifications to the example embodiments herein that a person having ordinary skill in the art would comprehend. Similarly, where appropriate, the appended claims encompass all changes, substitutions, variations, alterations, and modifications to the example embodiments herein that a person having ordinary skill in the art would comprehend. Modifications, additions, or omissions may be made to the arrangements described herein without departing from the scope of the disclosure. For example, the components of the arrangements may be integrated or separated. As used in this document, "each" refers to each member of a group/set or each member of a subgroup/subset of a group/set. Unless otherwise specifically noted, articles depicted in the drawings are not necessarily drawn to scale.

Although embodiments of the present disclosure have been described in detail, it should be understood that various changes, substitutions, and alterations could be made hereto without departing from the spirit and scope of the disclosure. Although specific advantages have been enumerated above, various embodiments may include some, none, or all of the enumerated advantages. Additionally, other technical advantages may become readily apparent to one of ordinary skill in the art after review of the foregoing figures and description.

The present disclosure extends to the following numbered statements, which are useful for understanding the present invention:

1. A reamer for use in enlarging a borehole in a drilling operation, the reamer comprising:

an elongate body defining a rotational axis about which the reamer is rotated in the drilling operation; and a plurality of reamer blocks configured to extend radially outwards from the elongate body relative to the rotational axis, wherein:

each reamer block comprises at least a first row of cutters configured to engage a formation in which the borehole is being drilled with a given back rake in the drilling operation, a given portion of each first row extending longitudinally along its reamer block, a longitudinal direction being substantially parallel to the rotational axis;

each back rake of said cutters is either a high back rake or a low back rake; and for at least one first row of cutters, the respective back rakes of the cutters alternate along the given portion of the row between one or more high back rakes and one or more low back rakes.

2. The reamer according to statement 1, wherein, for said at least one first row of cutters, the back rakes alternate one to the next along the given portion of the row between a high back rake and a low back rake.

3. The reamer according to statement 1 or 2, wherein, for each first row of cutters, the back rakes alternate along the given portion of the row between one or more high back rakes and one or more low back rakes.

4. The reamer according to any of the preceding statements, wherein:

each reamer block comprises at least a second row of cutters configured to engage the formation in which the borehole is being drilled with a back rake in the drilling operation, a given portion of each second row extending longitudinally along its reamer block; and for at least one second row of cutters, the respective back rakes of the cutters alternate along the given portion of the row between one or more high back rakes and one or more low back rakes.

5. The reamer according to statement 4, wherein, for said at least one second row of cutters, the back rakes alternate one to the next along the given portion of the row between a high back rake and a low back rake.

6. The reamer according to statement 4 or 5, wherein, for each second row of cutters, the back rakes alternate along the given portion of the row between one or more high back rakes and one or more low back rakes.

7. The reamer according to any of the preceding statements, wherein:

a given section of the reamer extends between two positions along its longitudinal length;

the first rows of cutters constitute a set of rows of cutters, and/or the second rows of cutters constitute a set of rows of cutters, and/or the rows of cutters on a given reamer block constitute a set of rows of cutters; and the reamer blocks are configured and positioned longitudinally along the reamer so that for at least one said set of rows of cutters, or for each set of rows of cutters on a set-by-set basis, the given portions of the rows extend longitudinally across the given section of the reamer.

8. The reamer according to statement 7, wherein, for at least one said set of rows of cutters or for each set of rows of cutters on a set-by-set basis, the cutters are mounted in respective longitudinal positions along their respective rows so that, for the given portions of the rows, the cutters with the high back rakes together span the given section of the reamer in the longitudinal direction; and/or the cutters with the low back rakes together span the given section of the reamer in the longitudinal direction.

9. The reamer according to statement 7 or 8, wherein, for at least one said set of rows of cutters or for each set of rows of cutters on a set-by-set basis, the cutters are mounted in respective longitudinal positions along their respective rows so that, for the given portions of the rows, the cutters with the high back rakes are longitudinally offset from one another between reamer blocks, optionally in addition to being transversely offset from one another between reamer blocks; and/or the cutters with the low back rakes are longitudinally offset from one another between reamer blocks, optionally in addition to being transversely offset from one another between reamer blocks.

10. The reamer according to any of statements 7 to 9, wherein, for at least one said set of rows of cutters or for each set of rows of cutters on a set-by-set basis, the cutters are mounted in respective longitudinal positions along their respective rows so that, for the given portions of the rows:

cutter paths through which the respective cutters with the high back rakes pass as the reamer is rotated are mutually substantially adjacent or at least partially overlap in the longitudinal direction; and/or cutter paths through which the respective cutters with the low back rakes pass as the reamer is rotated are mutually substantially adjacent or at least partially overlap in the longitudinal direction.

11. The reamer according to any of the preceding statements, wherein, for the given portions of the rows:

each high back rake is within a high range of back rakes and each low back rake is within a low range of back rakes, the high range comprising higher back rakes than the low range, optionally wherein a difference between the high back rakes and the low back rakes or between an average of the high range and an average of the low range is at least 10% or 20% or is at least 15% to 50% or is around 20%; and/or the high back rakes have a high average of back rakes and the low back rakes have a low average of back rakes, the high average of back rakes being higher than the low average of back rakes, optionally wherein a difference between the high average of back rakes and the low average of back rakes is at least 10% or 20% or is at least 15% to 50% or is around 20%.

12. The reamer according to any of the preceding statements, wherein, for at least one said row of cutters, or for at least one said set of rows of cutters, or for each set of rows of cutters on a set-by-set basis, the high back rakes for the given portions of the rows are substantially the same as one another and/or the low back rakes for the given portions of the rows are substantially the same as one another.

13. The reamer according to any of the preceding statements, wherein:

back rakes of the cutters are first-feature values of the cutters, where back rake is a first feature defining a configuration of the cutters;

each cutter has a second-feature value being a value of a second feature which defines a configuration of the cutter; and for said at least one said row of cutters, the respective second-feature values of the cutters alternate along the given portion of the row between one or more high second-feature values and one or more low second-feature values.

14. The reamer according to statement 13, wherein, for the given portions of the rows, the cutters having the low back rakes have the low second-feature values and the cutters having the high back rakes have the high second-feature values, or vice versa.

15. The reamer according to statement 13 or 14, wherein, for the given portions of the rows:

each high second-feature value is within an upper range of second-feature values and each low second-feature value is within a lower range of second-feature values, the upper range comprising larger second-feature values than the lower range, optionally wherein a difference between the high second-feature values and the low second-feature values or between an average of the upper range and an average of the lower range is at least 10% or 20% or is at least 15% to 50% or is around 20%; and/or the high second-feature values have a high average of second-feature values and the low second-feature values have a low average of second-feature values, the high average of second-feature values being higher than the low average of second-feature values, optionally wherein a difference between the high average of second-feature values and the low average of second-feature values is at least 10% or 20% or is at least 15% to 50% or is around 20%.

16. The reamer according to statement 15, wherein the second feature is a feature other than back rake and comprises at least one of:

a feature defining cutter geometry;

a feature defining cutter configuration;

cutter-face surface area;

cutter-face perimeter;

cutter-face major axis and/or cutter-face minor axis;

cutter exposure;

an impact versus abrasion resistance property; and diamond table thickness.

17. The reamer according to any of the preceding statements, wherein the reamer blocks are configured to extend radially outwards from the elongate body at substantially the same longitudinal position along the reamer.

18. The reamer according to any of the preceding statements, wherein:

each reamer block comprises a reamer body surface which faces radially outwards from the elongate body and extends along a length of the reamer block, the length defined in the longitudinal direction; and for each reamer block, the cutters of the given portions of the rows are mounted on its reamer body surface.

19. The reamer according to any of the preceding statements, wherein:

the elongate body has a downhole end and an uphole end, the downhole end configured to be downhole of the uphole end in the drilling operation;

for each reamer block, a hole-opening section of its reamer body surface extends across the given section of the reamer and slopes radially inwards along its length towards the downhole end; and for each reamer block, the cutters of the given portions of the rows are mounted on the hole-opening section of its reamer body surface so that when those cutters engage the formation in which the borehole is being drilled in the drilling operation a cross-section of the borehole perpendicular to the rotational axis is enlarged.

20. The reamer according to any of the preceding statements, wherein:

the rotational axis runs longitudinally through the elongate body; and/or the borehole is a borehole in an earthen formation; and/or the borehole is for the extraction of hydrocarbon materials; and/or the reamer is an underreamer; and/or each reamer block is extendible from and retractable toward the rotational axis.

21. A plurality of reamer blocks for mounting to an elongate body of a reamer, the reamer for use in enlarging a borehole in a drilling operation, the elongate body defining a rotational axis about which the reamer is rotated in the drilling operation, the reamer blocks configured to extend radially outwards from the elongate body relative to the rotational axis when mounted to the elongate body, wherein:

each reamer block comprises at least a first row of cutters configured to engage a formation in which the borehole is being drilled with a given back rake in the drilling operation, a given portion of each first row extending longitudinally along its reamer block, a longitudinal direction being substantially parallel to the rotational axis when the reamer block is mounted to the elongate body;

each back rake of said cutters is either a high back rake or a low back rake; and for at least one first row of cutters, the respective back rakes of the cutters alternate along the given portion of the row between one or more high back rakes and one or more low back rakes.

22. A reamer block for mounting to an elongate body of a reamer, the reamer for use in enlarging a borehole in a drilling operation, the elongate body defining a rotational axis about which the reamer is rotated in the drilling operation, the reamer block configured to extend radially outwards from the elongate body relative to the rotational axis when mounted to the elongate body, wherein:

the reamer block comprises at least a first row of cutters configured to engage a formation in which the borehole is being drilled with a given back rake in the drilling operation, a given portion of the first row extending longitudinally along its reamer block, a longitudinal direction being substantially parallel to the rotational axis when the reamer block is mounted to the elongate body;

each back rake of said cutters is either a high back rake or a low back rake; and for at least said first row of cutters, the respective back rakes of the cutters alternate along the given portion of the row between one or more high back rakes and one or more low back rakes.

23. A reamer for use in enlarging a borehole in a drilling operation, the reamer comprising a plurality of (first) rows of cutters configured to engage a formation in which the borehole is being drilled with a given back rake in a drilling operation, wherein:

each back rake of said cutters is either a high back rake or a low back rake; and for at least one (first) row of cutters, the respective back rakes of the cutters alternate along a given portion of the row between one or more high back rakes and one or more low back rakes.

24. The reamer according to statement 23, wherein the reamer comprises:

an elongate body defining a rotational axis about which the reamer is rotated in the drilling operation; and a plurality of reamer blocks configured to extend radially outwards from the elongate body relative to the rotational axis, wherein:

each reamer block comprises at least a respective first row of cutters configured to engage the formation, a given portion of each first row extending longitudinally along its reamer block, a longitudinal direction being substantially parallel to the rotational axis.

25. A reamer for use in enlarging a borehole in a drilling operation, the reamer comprising:

an elongate body defining a rotational axis about which the reamer is rotated in the drilling operation; and a plurality of reamer blocks configured to extend radially outwards from the elongate body relative to the rotational axis, wherein:

each reamer block comprises at least a first row of cutters configured to engage a formation in which the borehole is being drilled in the drilling operation, a given portion of each first row extending longitudinally along its reamer block, a longitudinal direction being substantially parallel to the rotational axis;

each cutter has a first-feature value being a value of a first feature which defines a configuration of the cutter; and for at least one first row of cutters, the respective first-feature values of the cutters alternate along the given portion of the row between one or more high first-feature values and one or more low first-feature values.

26. The reamer according to statement 25, wherein:

each reamer block comprises at least a second row of cutters configured to engage the formation in which the borehole is being drilled in the drilling operation, a given portion of each second row extending longitudinally along its reamer block; and for at least one second row of cutters, the respective first-feature values of the cutters alternate along the given portion of the row between one or more high first-feature values and one or more low first-feature values.

27. The reamer according to statement 25 or 26, wherein:

each cutter has a second-feature value being a value of a second feature which defines the configuration of the cutter; and for at least one said row of cutters, the respective second-feature values of the cutters alternate along the given portion of the row between one or more high second-feature values and one or more low second-feature values.

28. The reamer according to statement 27, wherein the cutters having the high second-feature values have the high first-feature values and the cutters having the low second-feature values have the low first-feature values, or vice versa.

29. The reamer according to statement 28, wherein the second feature is a feature different from the first feature, and wherein the first and second features each comprise at least one of:

back rake of the cutter;

a feature defining cutter geometry;

a feature defining cutter configuration;

cutter-face surface area;

cutter-face perimeter;

cutter-face major axis and/or cutter-face minor axis;

cutter exposure;

an impact versus abrasion resistance property; and diamond table thickness.

30. The reamer according to any of statements 25 to 29, wherein the first feature is back rake of the cutter.

31. A plurality of reamer blocks for mounting to an elongate body of a reamer, the reamer for use in enlarging a borehole in a drilling operation, the elongate body defining a rotational axis about which the reamer is rotated in the drilling operation, the reamer blocks configured to extend radially outwards from the elongate body relative to the rotational axis when mounted to the elongate body, wherein:

each reamer block comprises at least a first row of cutters configured to engage a formation in which the borehole is being drilled in the drilling operation, a given portion of each first row extending longitudinally along its reamer block, a longitudinal direction being substantially parallel to the rotational axis when the reamer block is mounted to the elongate body;

each cutter has a first-feature value being a value of a first feature which defines a configuration of the cutter; and for at least one first row of cutters, the respective first-feature values of the cutters alternate along the given portion of the row between one or more high first-feature values and one or more low first-feature values.

32 A reamer block for mounting to an elongate body of a reamer, the reamer for use in enlarging a borehole in a drilling operation, the elongate body defining a rotational axis about which the reamer is rotated in the drilling operation, the reamer block configured to extend radially outwards from the elongate body relative to the rotational axis when mounted to the elongate body, wherein:

the reamer block comprises at least a first row of cutters configured to engage a formation in which the borehole is being drilled in the drilling operation, a given portion of the first row extending longitudinally along its reamer block, a longitudinal direction being substantially parallel to the rotational axis when the reamer block is mounted to the elongate body;

each cutter has a first-feature value being a value of a first feature which defines a configuration of the cutter; and for at least the first row of cutters, the respective first-feature values of the cutters alternate along the given portion of the row between one or more high first-feature values and one or more low first-feature values.

33. A reamer for use in enlarging a borehole in a drilling operation, the reamer comprising a plurality of (first) rows of cutters configured to engage a formation in which the borehole is being drilled in a drilling operation, wherein:

each cutter has a first-feature value being a value of a first feature which defines a configuration of the cutter; and for at least one (first) row of cutters, the respective first-feature values of the cutters alternate along a given portion of the row between one or more high first-feature values and one or more low first-feature values.

34. The reamer according to statement 33, wherein the reamer comprises:

an elongate body defining a rotational axis about which the reamer is rotated in the drilling operation; and a plurality of reamer blocks configured to extend radially outwards from the elongate body relative to the rotational axis, wherein:

each reamer block comprises at least a respective first row of cutters configured to engage the formation, a given portion of each first row extending longitudinally along its reamer block, a longitudinal direction being substantially parallel to the rotational axis.

The invention claimed is:

1. A reamer for use in enlarging a borehole in a drilling operation, the reamer comprising:

an elongate body defining a rotational axis about which the reamer is rotated in the drilling operation; and a plurality of reamer blocks configured to extend radially outwards from the elongate body relative to the rotational axis, wherein:

each reamer block comprises a row of cutters configured to engage a formation in which the borehole is being drilled with a given back rake in the drilling operation, the row of cutters of each reamer block comprising a plurality of portions, a given portion of the row of cutters extending longitudinally along its reamer block, a longitudinal direction being substantially parallel to the rotational axis;

each back rake of said cutters is either a high back rake or a low back rake; and the respective back rakes of the cutters alternate along each of the plurality of portions of the row of cutters between one or more of the high back rakes and one or more of the low back rakes.

2. The reamer as claimed in claim 1, wherein the back rakes alternate one to the next along each of the plurality of portions of the row of cutters between the high back rake and the low back rake.

3. The reamer as claimed in claim 1, wherein, for the row of cutters, a first portion of the plurality of portions has a first arrangement of back rakes, and wherein a second portion of the plurality of portions has a second arrangement of back rakes that differs from the first arrangement.

4. The reamer as claimed in claim 1, wherein:

at least one of the plurality of reamer blocks comprises a second row of cutters configured to engage the formation in which the borehole is being drilled with the back rake in the drilling operation, the second row of cutters comprising a plurality of second portions, a given portion of the second row of cutters extending longitudinally along its reamer block; and the respective back rakes of the cutters alternate along each portion of the plurality of second portions of the second row between one or more of the high back rakes and one or more of the low back rakes.

5. The reamer as claimed in claim 4, wherein the back rakes alternate one to the next along each of the plurality of second portions of the second row of cutters between the high back rake and the low back rake.

6. The reamer as claimed in claim 4, wherein, for the second row of cutters, a first portion of the plurality of second portions has a first arrangement of back rakes, and wherein a second portion of the plurality of second portions has a second arrangement of back rakes that differs from the first arrangement.

7. The reamer as claimed in claim 4, wherein:

a given section of the reamer extends between two positions along its longitudinal length;

the rows of cutters constitute a set of rows of cutters, and/or the second rows of cutters constitute a set of rows of cutters, and/or the row and the second row of cutters on a given reamer block constitute a set of rows of cutters; and the plurality of reamer blocks are configured and positioned longitudinally along the reamer so that for at least one said set of rows of cutters, or for each set of rows of cutters on a set-by-set basis, the given portions of the rows extend longitudinally across the given section of the reamer.

8. The reamer as claimed in claim 7, wherein, for the at least one said set of rows of cutters or for each set of the rows of cutters on a set-by-set basis, the cutters are mounted in respective longitudinal positions along their respective rows so that, for the given portions of the rows;

the cutters with the high back rakes together span the given section of the reamer in the longitudinal direction; and/or the cutters with the low back rakes together span the given section of the reamer in the longitudinal direction.

9. The reamer as claimed in claim 7, wherein, for the at least one said set of rows of cutters or for each set of the rows of cutters on a set-by-set basis, the cutters are mounted in respective longitudinal positions along their respective rows so that, for the given portions of the rows;

the cutters with the high back rakes are longitudinally offset from one another between reamer blocks in addition to being transversely offset from one another between reamer blocks; and/or the cutters with the low back rakes are longitudinally offset from one another between reamer blocks in addition to being transversely offset from one another between reamer blocks.

10. The reamer as claimed in claim 7, wherein, for the at least one said set of rows of cutters or for each set of the rows of cutters on a set-by-set basis, the cutters are mounted in respective longitudinal positions along their respective rows so that, for the given portions of the rows;

cutter paths through which the respective cutters with the high back rakes pass as the reamer is rotated are mutually substantially adjacent or at least partially overlap in the longitudinal direction; and/or cutter paths through which the respective cutters with the low back rakes pass as the reamer is rotated are mutually substantially adjacent or at least partially overlap in the longitudinal direction.

11. The reamer as claimed in claim 7, wherein, for the at least one said row of cutters, or for the at least one said set of rows of cutters, or for each set of the rows of cutters on a set-by-set basis, the high back rakes for the given portions of the rows are substantially the same as one another and/or the low back rakes for the given portions of the rows are substantially the same as one another.

12. The reamer as claimed in claim 1, wherein, for the given portions of the rows of cutters of the plurality of reamer blocks:

each high back rake is within a high range of back rakes and each low back rake is within a low range of back rakes, the high range comprising higher back rakes than the low range, wherein a difference between the high back rakes and the low back rakes or between an average of the high range and an average of the low range is at least 10% or 20% or is at least 15% to 50% or is around 20%; and/or the high back rakes have a high average of back rakes and the low back rakes have a low average of back rakes, the high average of back rakes being higher than the low average of back rakes, wherein a difference between the high average of back rakes and the low average of back rakes is at least 10% or 20% or is at least 15% to 50% or is around 20%.

13. The reamer as claimed in claim 1, wherein:

back rakes of the cutters are first-feature values of the cutters, where back rake is a first feature defining a configuration of the cutters;

each cutter has a second-feature value being a value of a second feature which defines a configuration of the cutter; and for the row of cutters, the respective second-feature values of the cutters alternate along the given portion of the row between one or more high second-feature values and one or more low second-feature values, wherein, for the given portions of the row, the cutters having the low back rakes have the low second-feature values and the cutters having the high back rakes have the high second-feature values, or vice versa.

14. The reamer as claimed in claim 13, wherein, for the given portions of the rows:

each high second-feature value is within an upper range of second-feature values and each low second-feature value is within a lower range of second-feature values, the upper range comprising larger second-feature values than the lower range, wherein a difference between the high second-feature values and the low second-feature values or between an average of the upper range and an average of the lower range is at least 10% or 20% or is at least 15% to 50% or is around 20%; and/or the high second-feature values have a high average of second-feature values and the low second-feature values have a low average of second-feature values, the high average of second-feature values being higher than the low average of second-feature values, wherein a difference between the high average of second-feature values and the low average of second-feature values is at least 10% or 20% or is at least 15% to 50% or is around 20%.

15. The reamer as claimed in claim 14, wherein the second feature is a feature other than the back rake and comprises at least one of a group consisting of:

a feature defining cutter geometry;

a feature defining cutter configuration;

a cutter-face surface area;

a cutter-face perimeter;

a cutter-face major axis and/or a cutter-face minor axis;

a cutter exposure;

an impact versus abrasion resistance property; and a diamond table thickness.

16. The reamer as claimed in claim 1, wherein the reamer blocks are configured to extend radially outwards from the elongate body at substantially the same longitudinal position along the reamer.

17. The reamer as claimed in claim 1, wherein:

each reamer block comprises a reamer body surface which faces radially outwards from the elongate body and extends along a length of the reamer block, the length defined in the longitudinal direction; and for each reamer block, the cutters of the given portions of the row are mounted on its reamer body surface.

18. The reamer as claimed in claim 1, wherein:

the elongate body has a downhole end and an uphole end, the downhole end configured to be downhole of the uphole end in the drilling operation;

for each reamer block, a hole-opening section of its reamer body surface extends across the given section of the reamer and slopes radially inwards along its length towards the downhole end; and for each reamer block, the cutters of the given portions of the row of each reamer block are mounted on the hole-opening section of its reamer body surface so that when those cutters engage the formation in which the borehole is being drilled in the drilling operation a cross-section of the borehole perpendicular to the rotational axis is enlarged.

19. A plurality of reamer blocks for mounting to an elongate body of a reamer, the reamer for use in enlarging a borehole in a drilling operation, the elongate body defining a rotational axis about which the reamer is rotated in the drilling operation, the plurality of reamer blocks configured to extend radially outwards from the elongate body relative to the rotational axis when mounted to the elongate body, wherein:

each reamer block comprises a first a row of cutters configured to engage a formation in which the borehole is being drilled with a given back rake in the drilling operation, each row of cutters comprising a plurality of portions, a given portion of each row of cutters extending longitudinally along its reamer block, a longitudinal direction being substantially parallel to the rotational axis when the reamer block is mounted to the elongate body;

each back rake of said cutters is either a high back rake or a low back rake; and the respective back rakes of the cutters alternate along each of the plurality of portions of the row of cutters between one or more of the high back rakes and one or more of the low back rakes.

20. A reamer block for mounting to an elongate body of a reamer, the reamer for use in enlarging a borehole in a drilling operation, the elongate body defining a rotational axis about which the reamer is rotated in the drilling operation, the reamer block configured to extend radially outwards from the elongate body relative to the rotational axis when mounted to the elongate body, wherein:

the reamer block comprises a row of cutters configured to engage a formation in which the borehole is being drilled with a given back rake in the drilling operation, the row of cutters comprising a plurality of portions, a given portion of the row of cutters extending longitudinally along its reamer block, a longitudinal direction being substantially parallel to the rotational axis when the reamer block is mounted to the elongate body;

each back rake of said cutters is either a high back rake or a low back rake; and the respective back rakes of the cutters alternate along the given portion of the row of cutters between one or more of the high back rakes and one or more of the low back rakes.

* * * * *